US011192161B2

(12) United States Patent
Nitta et al.

(10) Patent No.: US 11,192,161 B2
(45) Date of Patent: Dec. 7, 2021

(54) HOLE WIDENING METHOD, FORMING TOOL, AND FORMED PRODUCT

(71) Applicant: NIPPON STEEL & SUMITOMO METAL CORPORATION, Tokyo (JP)

(72) Inventors: Jun Nitta, Tokyo (JP); Shigeru Yonemura, Tokyo (JP); Satoshi Shirakami, Tokyo (JP); Takashi Yasutomi, Tokyo (JP)

(73) Assignee: NIPPON STEEL CORPORATION, Tokyo (JP)

( * ) Notice: Subject to any disclaimer, the term of this patent is extended or adjusted under 35 U.S.C. 154(b) by 263 days.

(21) Appl. No.: 15/752,948

(22) PCT Filed: Sep. 2, 2016

(86) PCT No.: PCT/JP2016/075802
§ 371 (c)(1),
(2) Date: Feb. 15, 2018

(87) PCT Pub. No.: WO2017/038976
PCT Pub. Date: Mar. 9, 2017

(65) Prior Publication Data

US 2018/0200772 A1 Jul. 19, 2018

(30) Foreign Application Priority Data

Sep. 3, 2015 (JP) ..... JP2015-173669
Jan. 26, 2016 (JP) ..... JP2016-012360

(51) Int. Cl.
*B21D 19/10* (2006.01)
*B21D 19/08* (2006.01)
*B21D 28/28* (2006.01)

(52) U.S. Cl.
CPC ..... *B21D 19/10* (2013.01); *B21D 19/08* (2013.01); *B21D 19/088* (2013.01); *B21D 28/28* (2013.01)

(58) Field of Classification Search
CPC ..... B21D 19/10; B21D 19/08; B21D 19/088; B21D 19/005; B21D 28/24; B21D 28/26;
(Continued)

(56) References Cited

U.S. PATENT DOCUMENTS 6,931,901 B2 * 8/2005 Ghiran ..... B21D 28/28 29/421.1
2009/0018589 A1 * 1/2009 Smisson, III ..... A61B 17/863 606/301
2012/0274253 A1 * 11/2012 Fair ..... B25B 15/04 318/434

FOREIGN PATENT DOCUMENTS

DE 19924898 A1 * 12/2000 ..... B21D 41/02
JP 62-292219 A 12/1987
(Continued)

OTHER PUBLICATIONS

Machine Translation of JP-H0739948-A, Matsuo et al., Publication Year 1995, Total pp. 7 (Year: 2019).*
(Continued)

*Primary Examiner* — Teresa M Ekiert
*Assistant Examiner* — Sarkis A Aktavoukian
(74) *Attorney, Agent, or Firm* — Birch, Stewart, Kolasch & Birch, LLP

(57) ABSTRACT

There is provided a hole widening method including a preparing process of preparing a forming tool which has a diameter-increasing portion increasing in diameter from a front end side toward a rear end side and a line-shaped projection formed to protrude outward from a surface of the diameter-increasing portion, and a workpiece in which a pilot hole is formed; and a hole widening process of suc-
(Continued)

cessively widening the pilot hole by pushing the forming tool into the pilot hole such that the line-shaped projection of the forming tool comes into point contact with a part of a circumferential edge portion of the pilot hole in the workpiece two times or more, and forming a stretched flange.

4 Claims, 32 Drawing Sheets

(58) Field of Classification Search
CPC .... B21D 31/04; B21D 31/046; B21D 28/343; B21D 28/246; B21D 28/243
See application file for complete search history.

(56) References Cited

FOREIGN PATENT DOCUMENTS

| | | | |
|---|---|---|---|
| JP | 7-39945 | A | 2/1995 |
| JP | 7-39946 | A | 2/1995 |
| JP | 7-39948 | A | 2/1995 |
| JP | 2000-326018 | A | 11/2000 |
| JP | 2001-212625 | A | 8/2001 |
| JP | 2001-239325 | A | 9/2001 |
| JP | 2015-86415 | A | 5/2015 |
| RU | 2010650 | C1 | 4/1994 |
| RU | 2657253 | C2 | 6/2018 |
| SU | 732052 | A1 | 5/1980 |

OTHER PUBLICATIONS

Machine Translation of JP-H0739945-A, Katahira et al., Publication Year 1995, Total pp. 8 (Year: 2019).*
Russian Office Action and Search Report for counterpart Russian Application No. 2018107299 dated Nov. 28, 2018, with an English translation.
International Search Report for PCT/JP2016/075802 dated Dec. 6, 2016.
Nakagawa et al., "Cut-Off Punching Process—A New Method for Recovery of Stretchability of Sheared Edge", Plasticity and Process, 1969, vol. 10, No. 104, pp. 665-671.
Shirasawa et al., "Effect of Laser Cutting on Stretch Flangeability of High Strength Hot Rolled Steel Sheets", Iron and Steel, 1985, vol. 71, No. 16, pp. 1949-1955.
Written Opinion of the International Searching Authority for PCT/JP2016/075802 (PCT/ISA/237) dated Dec. 6, 2016.
Taiwanese Notice of Allowance and Search Report, dated May 1, 2018, for corresponding Taiwanese Application No. 105128461, along with English translations.

* cited by examiner

10E

10F

10G

10H

HOLE WIDENING METHOD, FORMING TOOL, AND FORMED PRODUCT

TECHNICAL FIELD OF THE INVENTION

The present invention relates to a hole widening method performed through press forming particularly with respect to members and the like for automobiles, a forming tool, and a formed product.

Priority is claimed on Japanese Patent Application No. 2015-173669, filed on Sep. 3, 2015, and Japanese Patent Application No. 2016-012360, filed on Jan. 26, 2016, the contents of which are incorporated herein by reference.

RELATED ART

Recently, high strength steel sheets are increasingly applied for the purpose of improving fuel efficiency and collision safety of automobiles. Complicated shapes are sometimes required for members for automobiles, and excellent working performance, that is, elongation and hole expansibility are important.

In hole widening, a forming tool, which increases in diameter from the front to the rear in a case of being seen in a progressing direction of pushing, is pushed into a pilot hole in a workpiece in which the pilot hole is provided in advance through punching or machining. Then, while a circumferential edge portion of the pilot hole is caused to extend in a pushing direction of the forming tool, the pilot hole is radially widened. Through this working method, a cylindrically protruding stretched flange is formed with respect to the workpiece.

The thickness of a formed stretched flange becomes thinner while being close to a front end portion of the stretched flange. The reason is that the front end portion corresponds to the circumferential edge portion of the workpiece, the degree of working at the time of hole widening increases while being close to the front end portion, and the distortion amount is significant. Therefore, for example, as shown in FIG. 1, in the case of forming a hole 112 and a flange 113 obtained by widening a pilot hole 111 before working through hole widening, a stretch flange crack 115 is sometimes caused in an edge portion 114 which is the front end portion of the stretched flange.

Generally, there is a trade-off relationship between elongation and hole expansibility of a steel sheet. In a high strength steel sheet having favorable elongation, hole expansibility generally tends to be degraded. Therefore, there has been a proposal in which elongation and hole expansibility are balanced by controlling the composition or the structure of a steel (for example, refer to Patent Document 1).

On the other hand, as a working technology for avoiding a stretch flange crack at the time of hole widening, a working method performed through a laser intercept method, a scraping method, or the like has been proposed (for example, refer to Non-Patent Documents 1 and 2 below). However, these methods require additional money and work, and there is a problem in productivity.

PRIOR ART DOCUMENT

Patent Document

[Patent Document 1] Japanese Unexamined Patent Application, First Publication No. 2015-086415

Non-Patent Document

[Non-Patent Document 1] Hidenori SHIRASAWA et al: Iron and Steel, Vol. 71, No. 16 (1985), p. 1949

[Non-Patent Document 2] Takeo NAKAGAWA et al: Journal of the Japan Society for Technology of Plasticity, Vol. 10, No. 104 (1969), p. 665

DISCLOSURE OF THE INVENTION

Problems to be Solved by the Invention

In hole widening, as described above, a crack is sometimes caused in a front end portion of a stretched flange. Particularly, in a high strength steel sheet having favorable elongation, hole widening tends to be difficult to be performed. In addition, although hole widening performed through press forming has an advantage of a short working time compared to those in the methods disclosed in Non-Patent Documents 1 and 2, there are cases where a phenomenon called "spring-back", in which a distorted material slightly returns to the original state, occurs when a forming tool is released.

The present invention has been made in consideration of the foregoing circumstances, and an object thereof is to provide a hole widening method which is performed through press forming while causing no crack in a front end portion of a stretched flange and being able to suppress spring-back after working, a forming tool which is preferably used in the hole widening method, and a formed product.

Means for Solving the Problem

The gist of the invention is as follows.

(1) According to a first aspect of the present invention, a hole widening method includes a preparing process of preparing a forming tool which has a diameter-increasing portion increasing in diameter from a front end side toward a rear end side and a line-shaped projection formed to protrude outward from a surface of the diameter-increasing portion, and a workpiece in which a pilot hole is formed; and a hole widening process of successively widening the pilot hole by pushing the forming tool into the pilot hole such that the line-shaped projection of the forming tool comes into point contact with a part of a circumferential edge portion of the pilot hole in the workpiece two times or more, and forming a stretched flange.

(2) In the hole widening method according to (1), in the hole widening process, the forming tool may be pushed into the pilot hole while the forming tool rotates about a central axis thereof in a pushing direction.

(3) According to a second aspect of the present invention, there is provided a forming tool used in the hole widening method according to (1) or (2). The forming tool includes a diameter-increasing portion that increases in diameter from a front end side toward a rear end side; and a line-shaped projection that is formed to protrude outward from a surface of the diameter-increasing portion. The line-shaped projection has a spiral shape in a case of being seen from the front end side. In a case of being seen in a cross section including a central axis of the diameter-increasing portion, two or more of the line-shaped projections are present on one circumferential surface of the diameter-increasing portion.

(4) In the forming tool according to (3), the line-shaped projection may extend over a surface of a body portion.

(5) According to a third aspect of the present invention, there is provided a forming tool used in the hole widening method according to (2). The forming tool includes a diameter-increasing portion that increases in diameter from a front end side toward a rear end side; a line-shaped projection that is formed to protrude outward from a surface of the diameter-increasing portion; and a rotation mechanism that is configured to rotate the diameter-increasing portion around a central axis thereof.

(6) In the forming tool according to (5), the line-shaped projection may have a linear shape in a case of being seen from the front end side.

(7) In the forming tool according to (5), the line-shaped projection may have a spiral shape in a case of being seen from the front end side.

(8) In the forming tool according to any one of (5) to (7), the line-shaped projection may extend over a surface of a body portion.

(9) According to a fourth aspect of the present invention, a formed product includes a stretched flange that is formed through the hole widening method according to (1) or (2).

Effects of the Invention

According to the aspects above, it is possible to prevent occurrence of a stretch flange crack at the time of hole widening even in a high strength steel sheet having favorable elongation, and it is possible to improve shape accuracy of a stretched flange by suppressing spring-back. Therefore, it is possible to apply stretch flange working or the like for forming members for automobiles with respect to a wide range of steel kinds. In addition, there is an advantage in that a forming tool after hole widening is easily released.

Particularly, in the hole widening method according to (1), the pilot hole is successively widened by pushing the forming tool into the pilot hole such that the line-shaped projection of the forming tool comes into point contact with a part of the circumferential edge portion of the pilot hole in a workpiece two times or more. Therefore, a force applied by the line-shaped projection is released before distortion such as elongation, occurrence of necking, and breaking progresses, and the pilot hole returns to the state before being distorted. Thus, a stretch flange crack can be suppressed. Furthermore, in a case of focusing on a particular part of the circumferential edge portion of the pilot hole in a workpiece, the particular part undergoes a cycle of loading, off-loading, and reloading a plurality of times. Accordingly, the particular part is in a working state similar to that in which a certain degree of stress releasing is performed at the time of completion of forming and correcting is performed a plurality of times, in addition thereto. Accordingly, spring-back of the circumferential edge portion can be suppressed.

Therefore, a stretch flange crack and spring-back can be suppressed.

In the hole widening method according to (2), the forming tool is pushed into the pilot hole while the forming tool rotates. Therefore, it is possible to adjust the number of times the line-shaped projection is brought into point contact with a particular part of the pilot hole, through a single press.

Therefore, a stretch flange crack and spring-back in a front end portion of the stretched flange can be more reliably suppressed.

In the forming tool according to (3), a stretch flange crack and spring-back can be suppressed by pushing the forming tool into the pilot hole.

In the forming tool according to (4), the line-shaped projection is also provided on the surface of the body portion. Therefore, it is possible to enhance release characteristics of the forming tool in a case of performing burring.

In the forming tool according to (5), a stretch flange crack and spring-back can be suppressed by pushing the forming tool into the pilot hole while the rotation mechanism rotates the forming tool. In addition, since the rotation mechanism rotates the forming tool, it is possible to use a linearly line-shaped projection or a spirally line-shaped projection of which the number of turns or the number of threads is not limited. Therefore, the manufacturing cost of the forming tool can be reduced.

In the forming tool according to (6), the linearly line-shaped projection is used. Therefore, the manufacturing cost of the forming tool can be reduced.

In the forming tool according to (7), the spirally line-shaped projection of which the number of turns or the number of threads is not limited is used. Therefore, the manufacturing cost of the forming tool can be reduced.

In the hole widening method according to (8), the line-shaped projection is also provided on the surface of the body portion. Therefore, it is possible to enhance release characteristics of the forming tool in a case of performing burring.

In the formed product according to (9), it is possible to obtain a component having no stretch flange crack and having high dimensional accuracy.

EMBODIMENT OF THE INVENTION

The inventors have intensively examined methods for preventing a stretch flange crack at the time of hole widening and reducing spring-back, particularly hole widening methods performed through press forming of a high strength steel sheet. As a result, it has been acknowledged that it is effective to successively perform hole widening by partially widening a pilot hole instead of concentrically widening the pilot hole at the time of hole widening.

Hereinafter, the present invention which has been made based on the foregoing knowledge will be described in detail with reference to the drawings.

Figure 1:
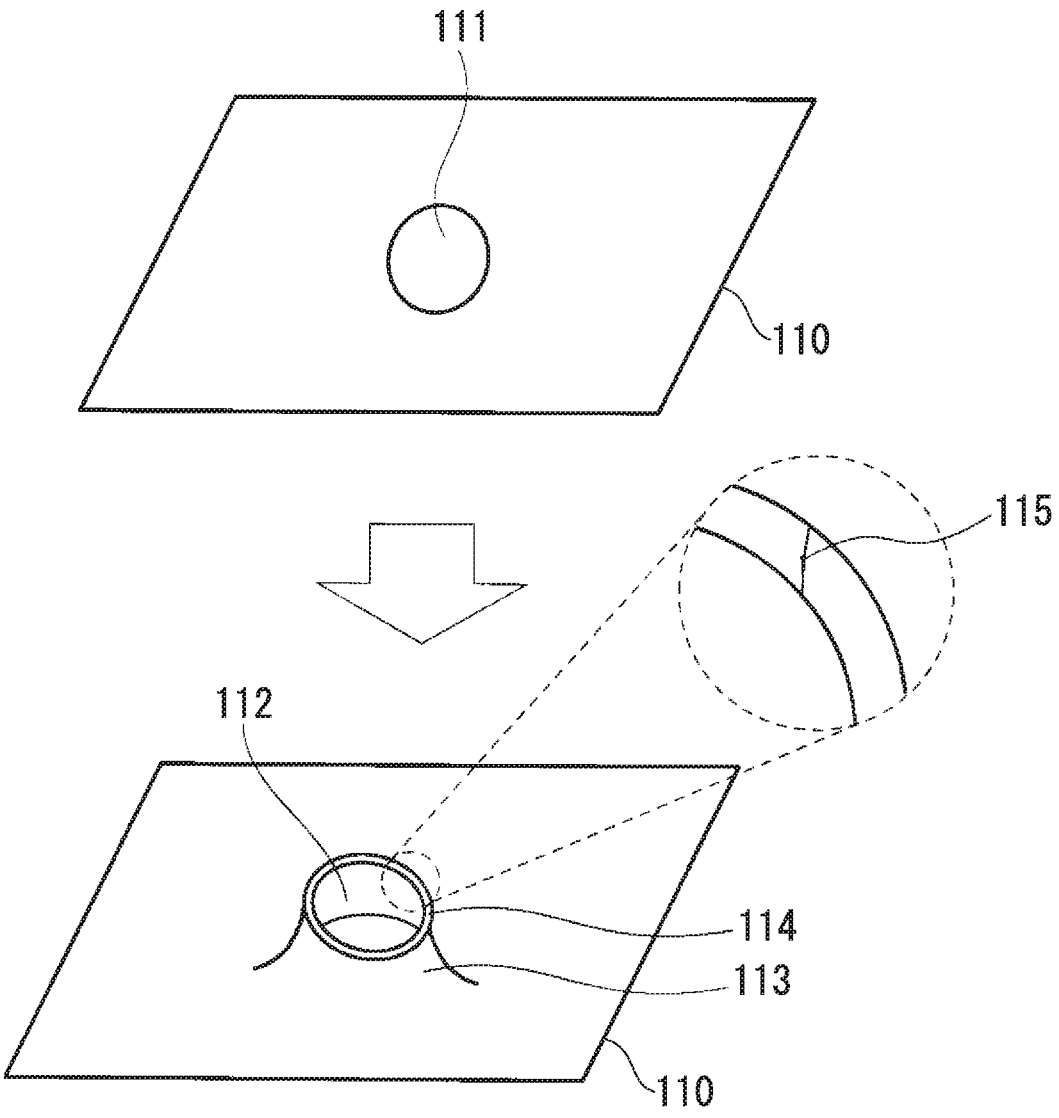
FIG. 1 is a perspective view showing a crack of the edge portion of the plate material caused by a hole widening method in the related art.
Figure 2A:
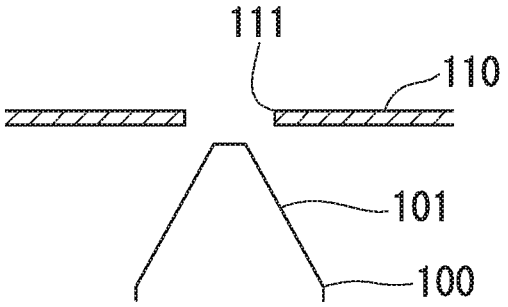
FIG. 2A is a view showing the hole widening method in the related art and is a part of a cross-sectional view showing a state before hole widening.
Figure 2B:
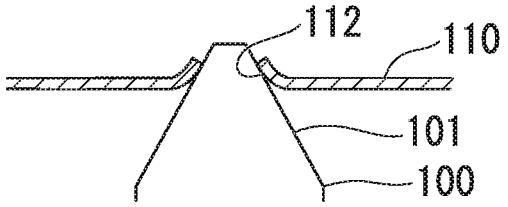
FIG. 2B is a view showing the hole widening method in the related art and is a part of a cross-sectional view showing a state at the time of completion of hole widening.

In a hole widening method in the related art, as shown in FIGS. 2A and 2B, in a state where a forming tool 100 having a diameter-increasing portion 101 increasing in diameter from a front end side toward a rear end side is brought into contact with the whole circumference of a circumferential edge portion of a circular pilot hole 111 formed in a steel sheet 110 (workpiece), the pilot hole 111 is pushed using the forming tool 100. Accordingly, the pilot hole 111 is concentrically widened, and a hole 112 is formed.

As the forming tool 100 is inserted into the pilot hole, the pilot hole 111 in the steel sheet 110 and the circumferential edge portion thereof are pushed out toward the front end side of the forming tool 100 such that a protruding portion is formed. Here, the front end side of the forming tool 100 denotes a side which first comes close to the pilot hole when the forming tool 100 is inserted into the pilot hole 111.

Figure 3:
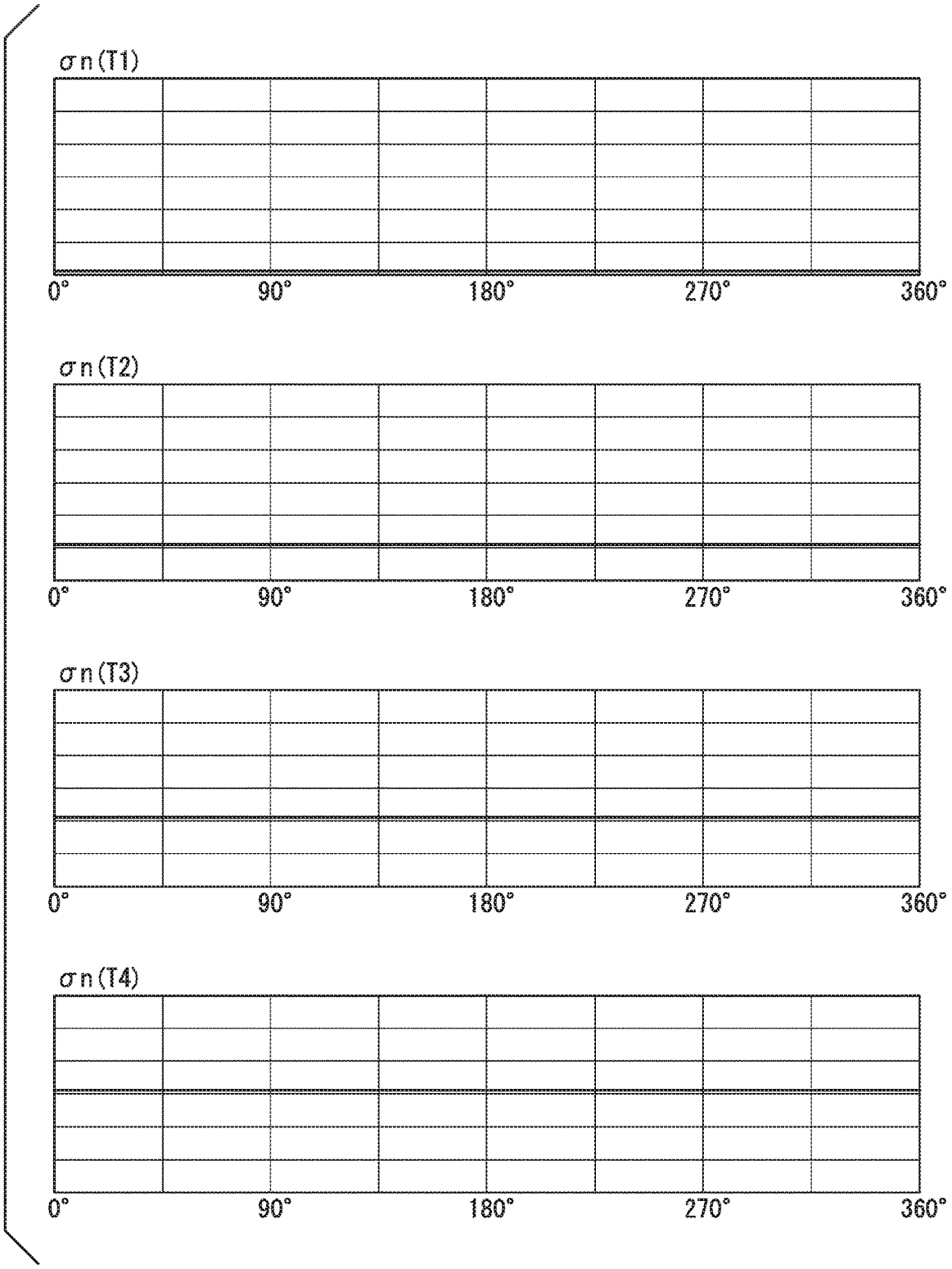
FIG. 3 relates to the hole widening method in the related art and is a graph in which a relationship between an angular position of a forming tool and an index σn is shown in time series.

FIG. 3 shows a graph having the horizontal axis for an angular position and the vertical axis for an index σn regarding working time points T1 to T4 in the hole widening method in the related art shown in FIGS. 2A and 2B.

The working time point T1 is a time point immediately after hole widening starts. The working time point T2 is a time point after the elapse of a time t1 from the working time point T1. The working time point T3 is a time point after the elapse of a time t2 from the working time point T2. The working time point T4 is a time point after the elapse of a time t3 from the working time point T3. The times t1 to t3 are not necessarily uniform.

The angular position is an angular position based on a center point (central axis) in a plan view of the forming tool.

The index σn is a size of a load vector cone per unit area pressing a steel sheet by the forming tool.

As shown in FIG. 3, in the hole widening method in the related art, the index σn at each working time point indicates a uniform value at every angular position. Since the work hardening amount of a steel sheet increases as the working time point progresses from T1 to T4, the value of the index σn increases gradually.

As a shape of the diameter-increasing portion 101, the shape only needs to increase in diameter from the front end side toward the rear end side. Therefore, a conical shape, a truncated conical shape, a cannon ball shape, or the like is preferably used. The diameter-increasing portion 101 is not limited to these shapes.

In this specification, the diameter-increasing portion denotes a part in which the diameter or the equivalent circle diameter of the contour of a cross section perpendicular to the central axis of the forming tool increases from the front end side toward the rear end side.

In the view showing the hole widening method, only the forming tool and the steel sheet are shown, and a die, a blank holder, and the like are omitted. General devices may be used as these omitted devices.

In contrast, the hole widening method according to an embodiment of the present invention includes a preparing process of preparing a forming tool and a steel sheet, and a hole widening process of forming a stretched flange in the steel sheet. In the hole widening process, the pilot hole is successively widened by pushing the forming tool into the pilot hole such that a line-shaped projection of the forming tool comes into point contact with a part of the circumferential edge portion of the pilot hole formed in the steel sheet, two or more.

In this specification, "coming into point contact with a part of the circumferential edge portion" excludes a case of "coming into contact with the whole circumference of the circumferential edge portion at the same time", and contact with a limited area is allowed.

Hereinafter, a more detailed description will be given using specific examples.

Figure 4A:
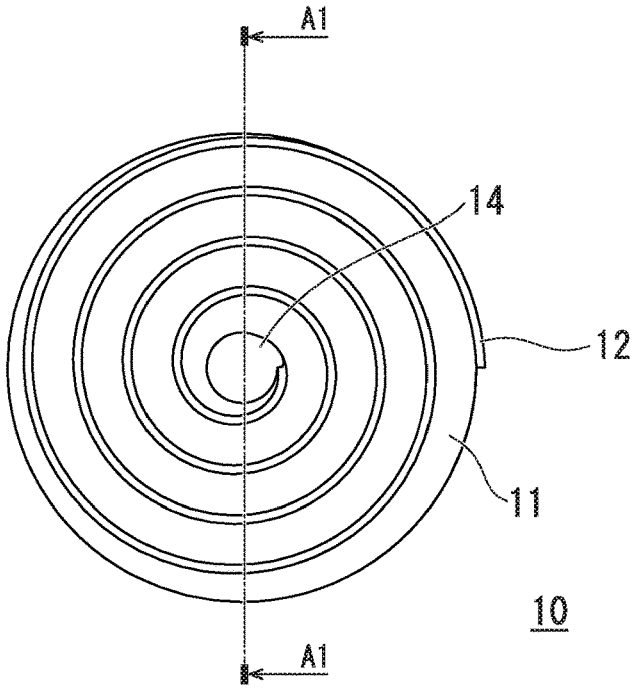
FIG. 4A is a plan view of the forming tool used in a hole widening method according to an embodiment of the present invention.
Figure 4B:
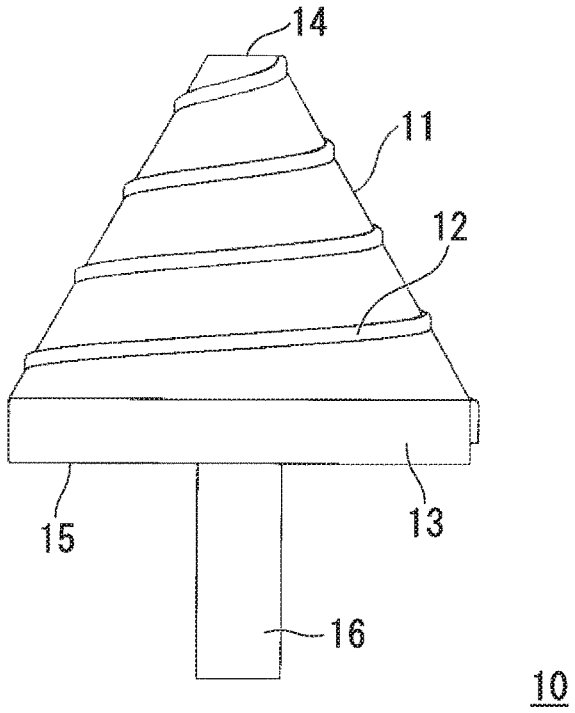
FIG. 4B is a side view of the same forming tool.
Figure 4C:
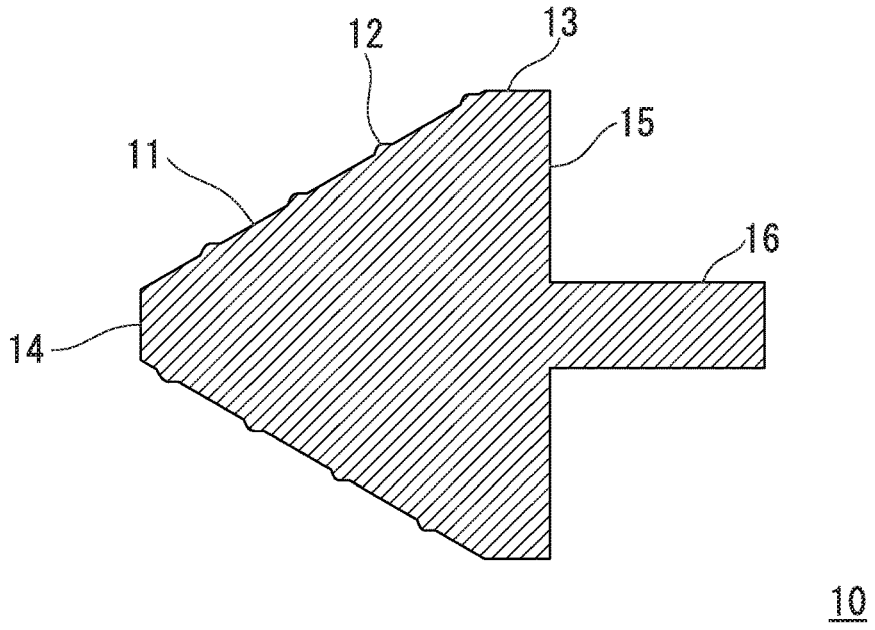
FIG. 4C is a cross-sectional view of the same forming tool obtained along line A1-A1 in FIG. 4A.

In the hole widening method according to the present embodiment, a forming tool 10 shown in FIGS. 4A to 4C can be used. FIG. 4A is a plan view, FIG. 4B is a side view, and FIG. 4C is a cross-sectional view obtained along line A1-A1 in FIG. 4A.

As shown in FIGS. 4A to 4C, this forming tool 10 includes a diameter-increasing portion 11 which has a truncated conical shape, a spirally line-shaped projection 12 which protrudes outward from a surface of the diameter-increasing portion 11, a body portion 13 which has a columnar shape and is formed on the rear end side of the diameter-increasing portion 11, an apex portion 14 which is formed on the front end side of the diameter-increasing portion 11, a bottom portion 15 which is formed on the rear end side of the body portion 13, and a gripping portion 16 of the bottom portion 15.

According to this forming tool 10, the line-shaped projection 12 is spirally provided in a case of being seen from the front end side. In addition, in regard to the line-shaped projection 12, in a case of being seen in a cross section including the central axis of the diameter-increasing portion 11, two or more line-shaped projections are present on one circumferential surface of the diameter-increasing portion.

Therefore, since a horizontal cross section of the diameter-increasing portion 11 does not have a circular shape, in a case where a circular pilot hole S1 is pushed using this forming tool 10, the whole circumference of the circumferential edge portion of the pilot hole S1 does not come into contact with the forming tool 10, but a part of the circumferential edge portion comes into point contact with the forming tool 10. That is, the line-shaped projection 12 comes into point contact with a part of the circumferential edge portion of the pilot hole S1. Then, when the forming tool 10 is pushed, the line-shaped projection can come into point contact with a part of the circumferential edge portion of the pilot hole S1 in a workpiece S two times or more.

Figure 5A:
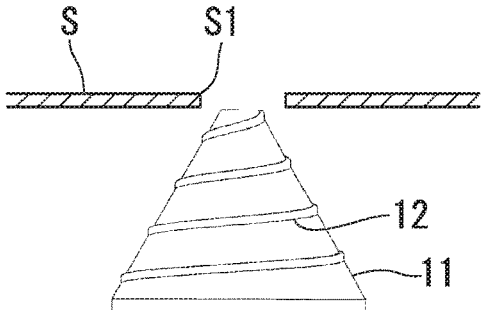
FIG. 5A is a part of a cross-sectional view showing a state before hole widening in the hole widening method using the same forming tool.
Figure 5B:
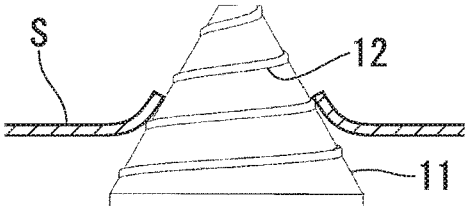
FIG. 5B is a part of a cross-sectional view showing a state at the time of completion of hole widening in the hole widening method using the same forming tool.

More specifically, as shown in FIGS. 5A and 5B, in a state where the forming tool 10 is brought into contact with a circumferential edge portion of the circular pilot hole S1 formed in the steel sheet S (workpiece), the pilot hole S1 is widened by pushing the forming tool 10 into the pilot hole S1, and a formed product is then obtained.

Figure 6A:
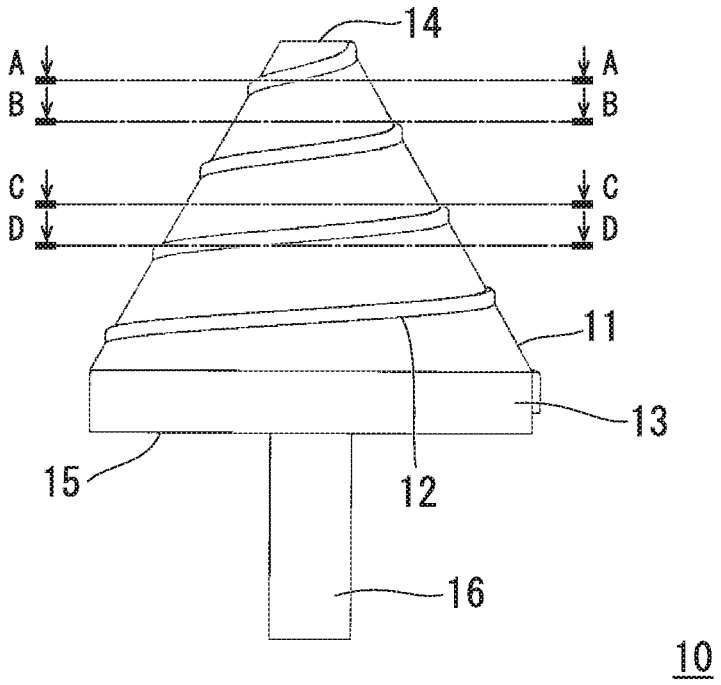
FIG. 6A is a side view for showing a change in a relationship between the same forming tool and a line-shaped projection.

FIGS. 6A to 6E schematically show a change in a relationship between the forming tool 10 and the line-shaped projection 12. FIG. 6A is a side view of the forming tool 10. FIGS. 6B to 6E are an arrow view along line A-A of the forming tool 10 shown in FIG. 6A, an arrow view along line B-B, an arrow view along line C-C, an arrow view along line D-D, and an arrow view along line E-E. In cross-sectional views shown in FIGS. 6B to 6E, oblique line regions indicate cross sections of the forming tool 10, and outer shape curve lines thereof become parts coming into contact with the steel sheet S shown in FIGS. 5A and 5B.

In the hole widening method using the forming tool 100 in the related art as shown in FIGS. 2A and 2B, the pilot hole 111 is widened while maintaining the circular shape. However, in the hole widening method according to the present embodiment, since the line-shaped projection 12 in each cross section comes into contact with the steel sheet S in priority, the hole shape in the middle of forming is a non-circular shape.

At the time of hole widening, the spirally line-shaped projection 12 comes into point contact with a part of the steel sheet S. Therefore, the part of the steel sheet S is pushed by the forming tool 10, and the pilot hole 111 is partially widened. As the forming tool 10 progresses, the state successively shifts from that in FIG. 6B to that in FIG. 6E. The contact position between the forming tool 10 and the steel sheet S changes, and the pilot hole 111 is successively widened. As a result, the stretched flange can be formed without causing a stretch flange crack at the time of hole widening.

Figure 6B:
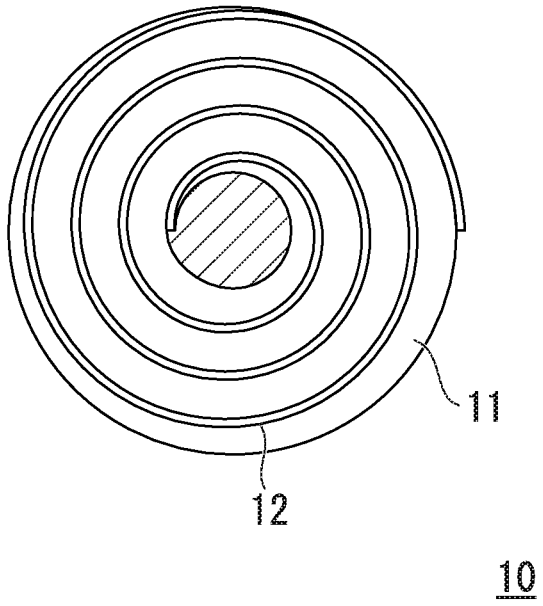
FIG. 6B is an arrow view along line A-A in FIG. 6A.
Figure 6C:
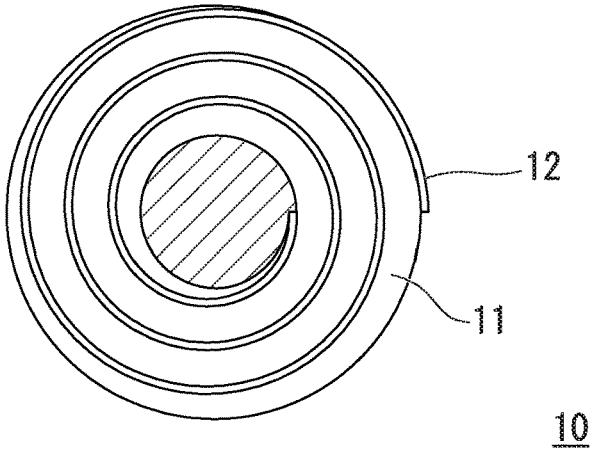
FIG. 6C is an arrow view along line B-B in FIG. 6A.
Figure 6D:
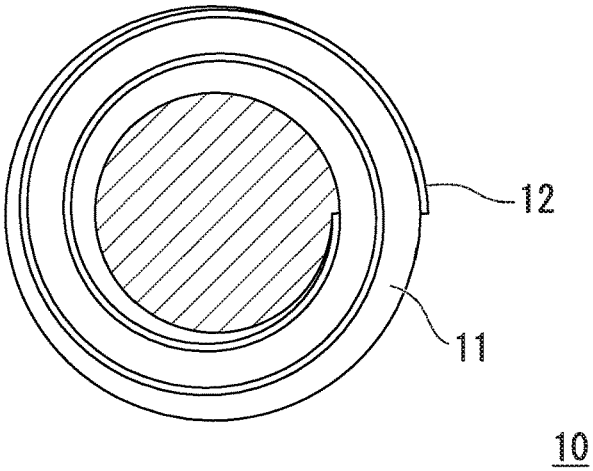
FIG. 6D is an arrow view along line C-C in FIG. 6A.
Figure 6E:
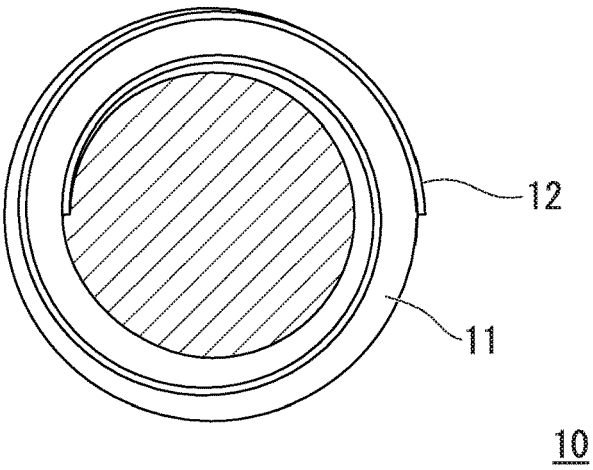
FIG. 6E is an arrow view along line D-D in FIG. 6A.

FIG. 6B is an initial stage of hole widening. The left side in the view of the circumferential edge portion of the pilot hole S1 is in contact with the spirally line-shaped projection 12 provided in the forming tool 10. However, in the pilot hole S1, a part adjacent to the part coming into contact with the line-shaped projection 12 does not come into contact with the forming tool 10. Therefore, a pushing/widening force of the forming tool 10 is intensively applied to the left side in the view of the pilot hole. Thereafter, the forming tool 10 moves relatively with respect to the steel sheet S. In the state of FIG. 6C, since the right side in the view of the pilot hole comes into contact with the spirally line-shaped projection 12 provided in the forming tool 10, a pushing/widening force of the forming tool 10 is intensively applied to the right side in the view. Between the states of FIGS. 6B and 6C, the contact position between the circumferential edge portion of the pilot hole 111 and the forming tool 10 changes continuously in accordance with movement of the forming tool 10. Accordingly, the location in the circumferential edge portion of the pilot hole 111 intensively receiving a pushing/widening force of the forming tool 10 also changes continuously. Thereafter, hole widening progresses similarly in FIGS. 6D and 6E as well.

Figure 7:
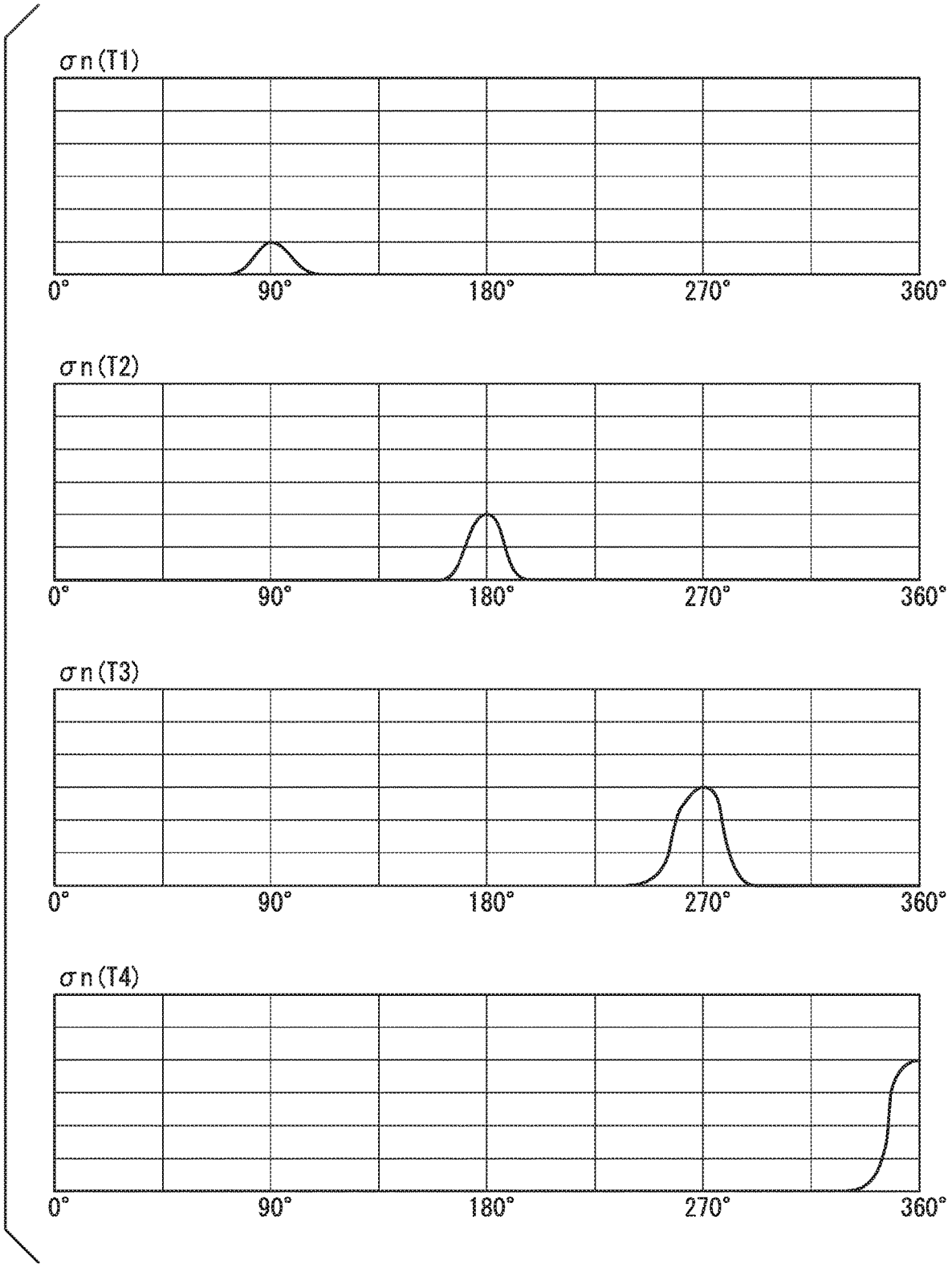
FIG. 7 relates to the hole widening method according to the same embodiment and is a graph in which a relationship between the angular position of the forming tool and the index σn is shown in time series.

FIG. 7 shows a graph having the horizontal axis for the angular position and the vertical axis for the index $\sigma n$ regarding the working time points T1 to T4 in the hole widening method according to the present embodiment.

As shown in FIG. 7, at the working time point T1, a peak of the index $\sigma n$ is generated at the 90-degree position, and as working progresses to the working time points T2 to T4, the peak of the index $\sigma n$ moves to positions of 180 degrees, 270 degrees, and 360 degrees. The peak gradually increases as working progresses from the working time point T1 to the working time point T4 due to an influence of work hardening of a workpiece plate.

The reason that no stretch flange crack is caused at the time of hole widening in the hole widening method according to the present embodiment is assumed as follows. That is, according to the hole widening method in the related art, as shown in FIG. 3, during working, since tensile stress is continuously applied to the whole circumference of the circumferential edge portion of the pilot hole 111 in the steel sheet 110 at all times, the circumferential edge portion is uniformly elongated. When tensile stress is continuously applied furthermore, necking is caused in a part of the circumferential edge portion, and a stretch flange crack is finally caused.

Meanwhile, according to the working method of the present invention, as shown in FIG. 7, at a certain time during working, the location to which a force is applied in the circumferential edge portion of the pilot hole S1 in the steel sheet S is a part of the circumferential edge portion, and the location to which a force is applied changes in accordance with a change in time. That is, the location to which tensile stress is applied becomes a part of the circumferential edge portion. Furthermore, in the location, tensile stress is released before breaking due to necking is caused, and tensile stress is applied to a different location. Therefore, even if a force is applied, the force is released before distortion such as elongation, occurrence of necking, and breaking progresses, and the pilot hole returns to the state before being distorted. Thus, a stretch flange crack can be suppressed.

Furthermore, in the hole widening method according to the present embodiment, a force is applied to only a part of the circumferential edge portion of the pilot hole S1 in the steel sheet S during working and the part moves as forming progresses. Therefore, in a case of focusing on a particular part of the circumferential edge portion to be worked, the particular part undergoes a cycle of loading, off-loading, and reloading a plurality of times. Accordingly, the particular part is in a working state similar to that in which a certain degree of stress releasing is performed at the time of completion of forming and correcting is performed a plurality of times, in addition thereto. Accordingly, spring-back of the circumferential edge portion can be suppressed. Thus, shape accuracy of the stretched flange is improved.

In addition, in a case where the forming tool 10 is in contact with only a part of the circumferential edge portion of the pilot hole S1 when working ends, the forming tool 10 is easily released.

In the hole widening method according to the present embodiment, without being limited to the forming tools 10 having the shapes described above, it is possible to use forming tools according to various modified examples. Hereinafter, for simplification of description, the same reference signs are used for the configurations which have already been described in the forming tool 10.

Figure 8A:
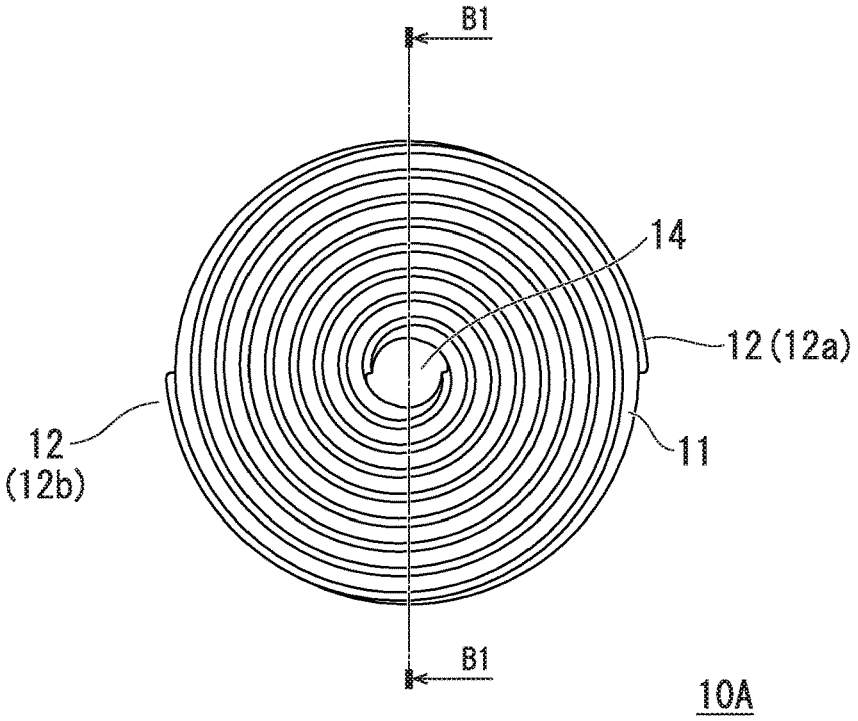
FIG. 8A is a plan view of a forming tool according to a first modified example.
Figure 8B:
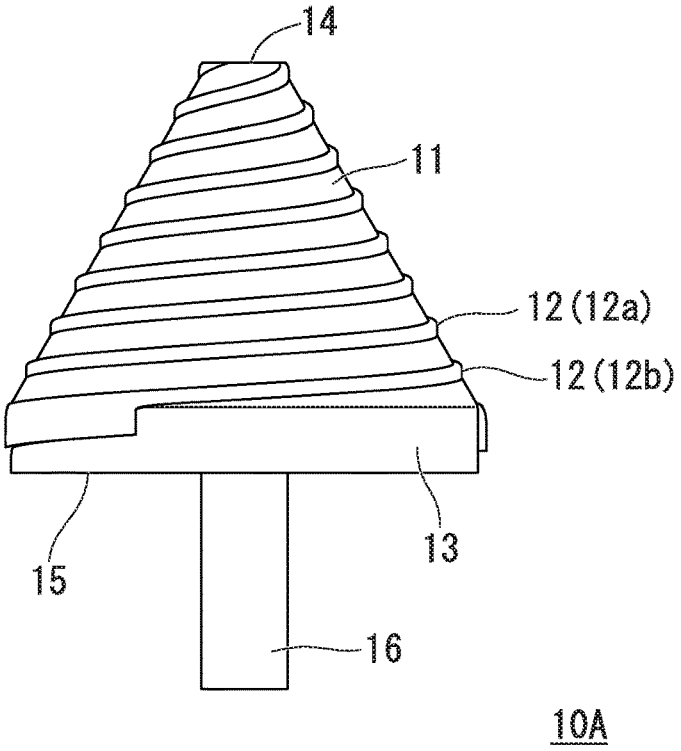
FIG. 8B is a side view of the same forming tool.
Figure 8C:
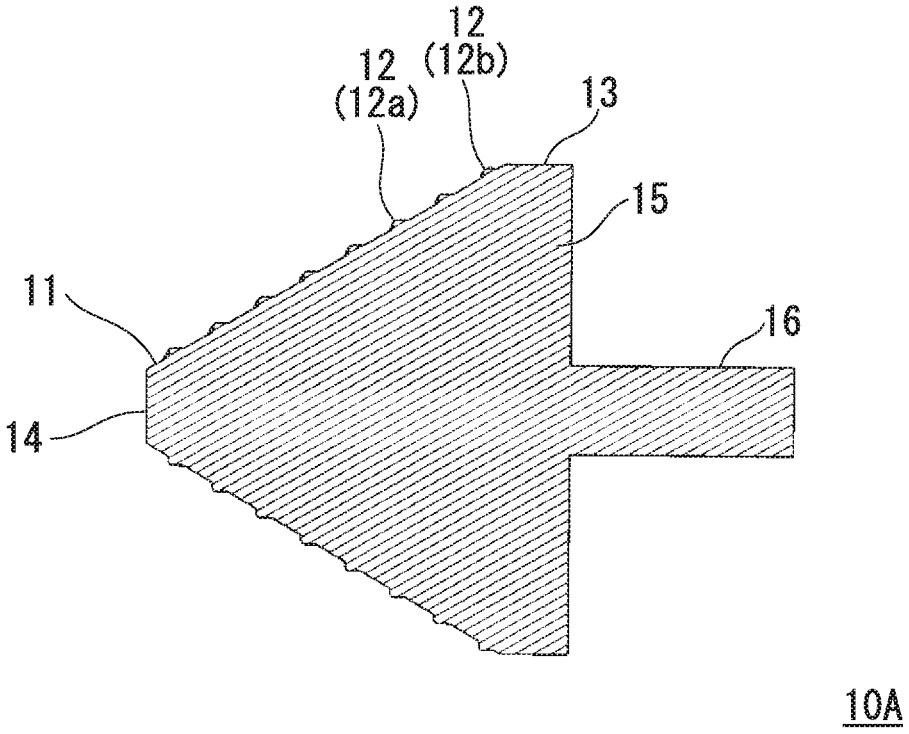
FIG. 8C is a cross-sectional view of the same forming tool obtained along line B1-B1 in FIG. 8A.

In a forming tool 10A according to a first modified example, as shown in FIGS. 8A to 8C, two line-shaped projections 12*a* and 12*b* are spirally formed on a surface of the diameter-increasing portion 11 in the same directions as each other. FIG. 8A is a plan view, FIG. 8B is a side view, and FIG. 8C is a cross-sectional view obtained along line B1-B1 in FIG. 8A.

Figure 9:
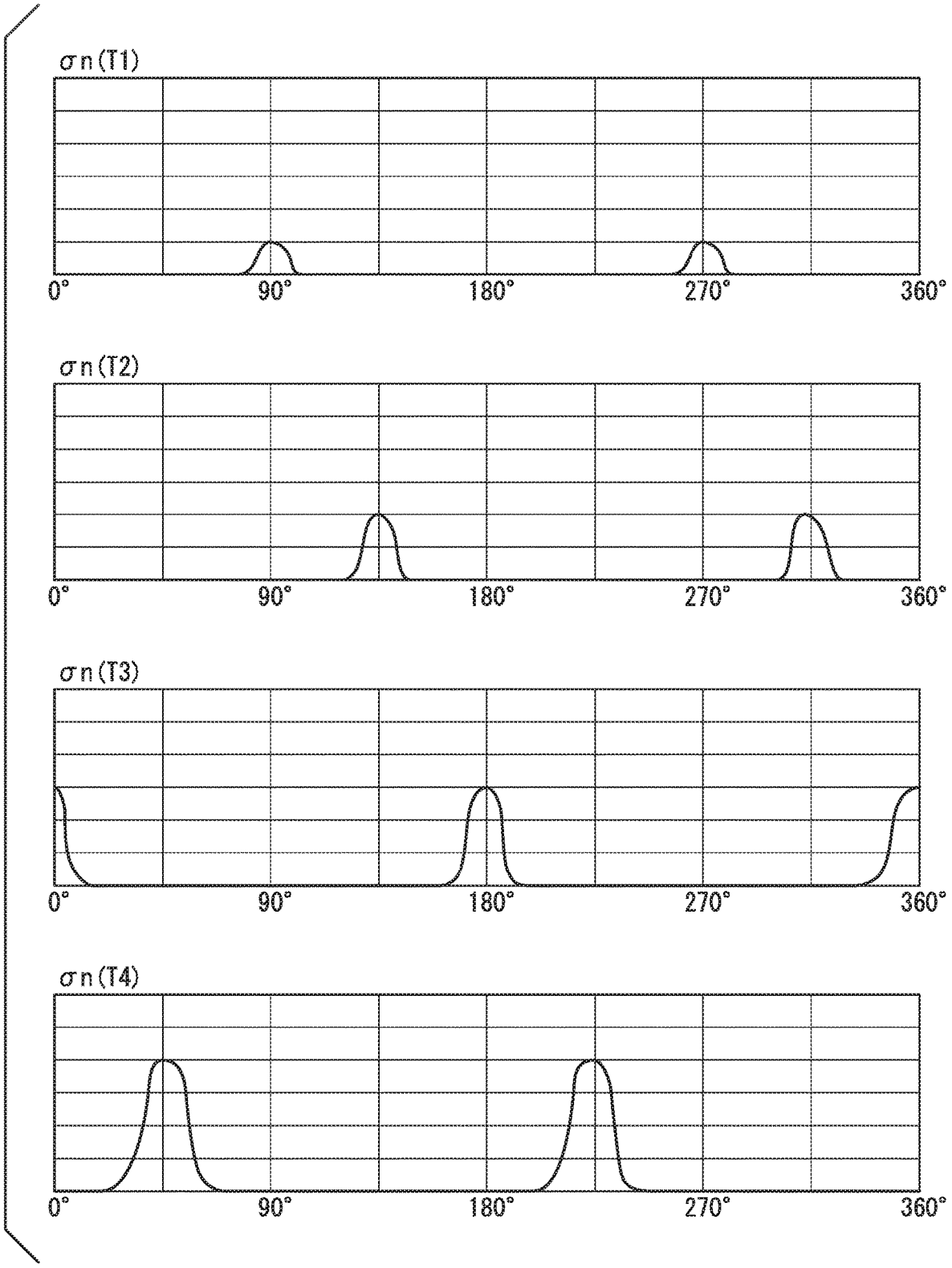
FIG. 9 relates to the hole widening method using the forming tool according to the first modified example and is a graph in which a relationship between the angular position of the forming tool and the index σn is shown in time series.

FIG. 9 shows a graph having the horizontal axis for the angular position and the vertical axis for the index σn regarding the working time points T1 to T4 in the hole widening method in a case of using the forming tool 10A according to the first modified example. As shown in this graph, in a case of using the forming tool 10A according to the first modified example, the number of peaks of the index σn can be two within the same cross section. Therefore, it is possible to further enhance the effect of preventing a stretch flange crack at the time of hole widening and the effect of reducing spring-back.

Figure 10A:
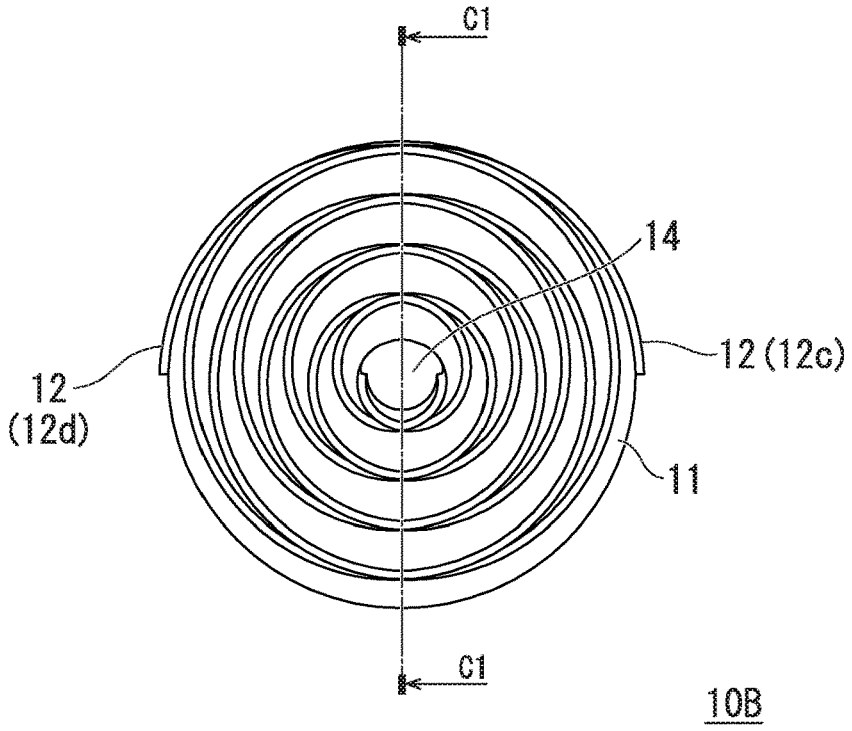
FIG. 10A is a plan view of a forming tool according to a second modified example.
Figure 10B:
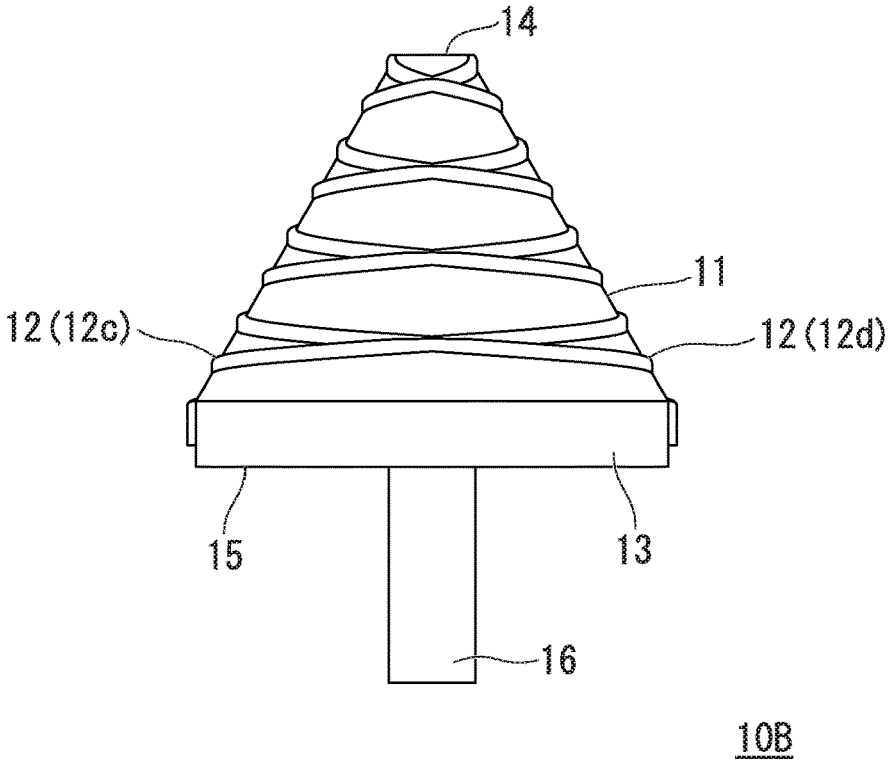
FIG. 10B is a side view of the same forming tool.
Figure 10C:
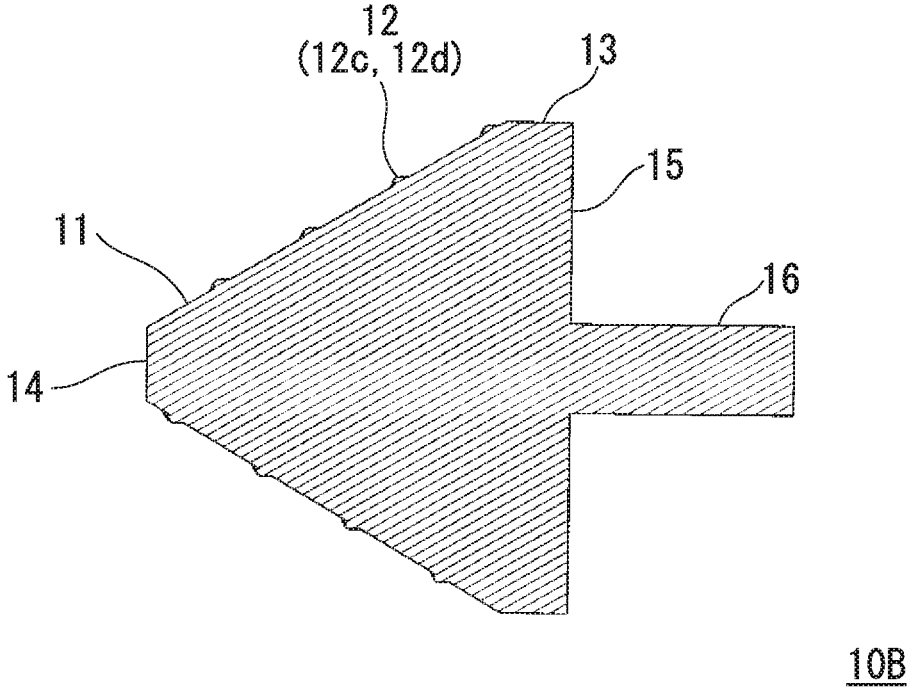
FIG. 10C is a cross-sectional view of the same forming tool obtained along line C1-C1 in FIG. 10A.

In a forming tool 10B according to a second modified example, as shown in FIGS. 10A to 10C, two line-shaped projections 12*c* and 12*d* are spirally formed on a surface of the diameter-increasing portion 11 in directions opposite to each other. FIG. 10A is a plan view, FIG. 10B is a side view, and FIG. 10C is a cross-sectional view obtained along line C1-C1 in FIG. 10A.

Figure 11:
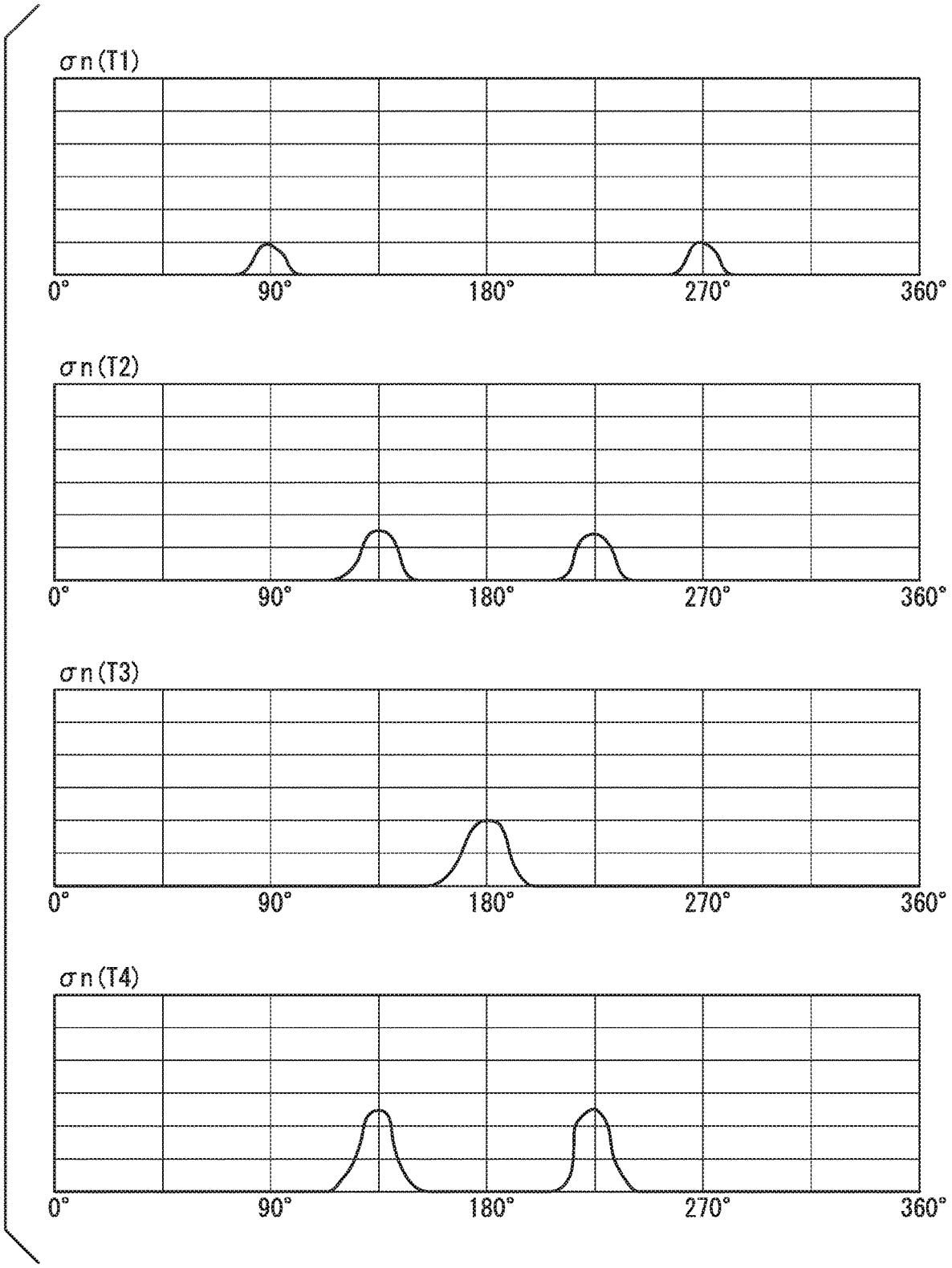
FIG. 11 relates to a hole widening method using the forming tool according to the second modified example and is a graph in which a relationship between the angular position of the forming tool and the index σn is shown in time series.

FIG. 11 shows a graph having the horizontal axis for the angular position and the vertical axis for the index σn regarding the working time points T1 to T4 in the hole widening method in a case of using the forming tool 10C according to the second modified example. As shown in this graph, even in a case of using the forming tool 10C according to the second modified example, similar to the forming tool 10B according to the first modified example, the number of peaks of the index σn within the same cross section can be increased. Therefore, it is possible to further enhance the effect of preventing a stretch flange crack at the time of hole widening and the effect of reducing spring-back.

Figure 12A:
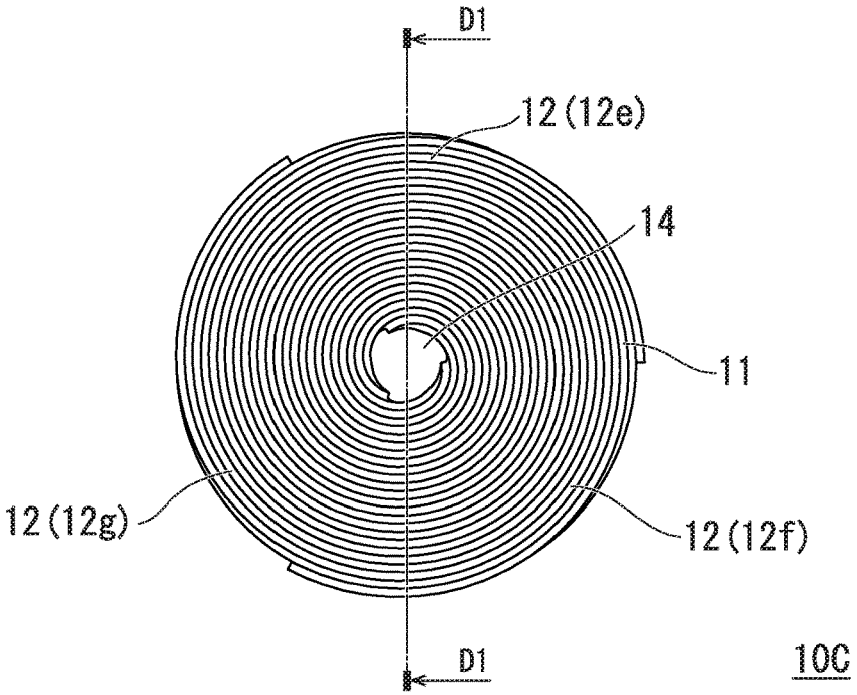
FIG. 12A is a plan view of the forming tool according to a third modified example.
Figure 12B:
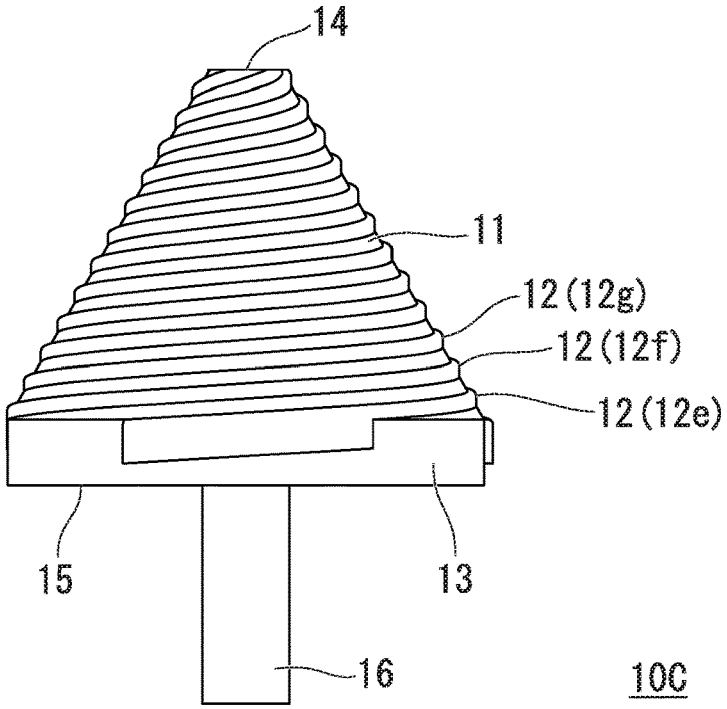
FIG. 12B is a side view of the same forming tool.
Figure 12C:
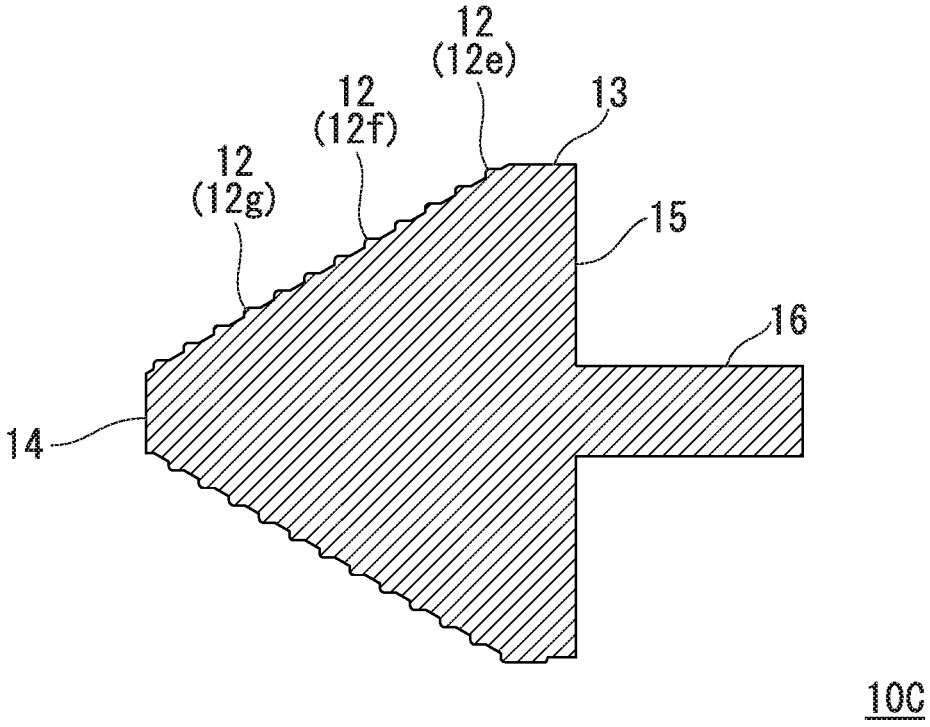
FIG. 12C is a cross-sectional view of the same forming tool obtained along line D1-D1 in FIG. 12A.

In a forming tool 10C according to a third modified example, as shown in FIGS. 12A to 12C, three line-shaped projections 12*e*, 12*f*, and 12*g* are spirally formed on a surface of the diameter-increasing portion 11 in the same directions as each other. FIG. 12A is a plan view, FIG. 12B is a side view, and FIG. 12C is a cross-sectional view obtained along line D1-D1 in FIG. 12A.

Figure 13:
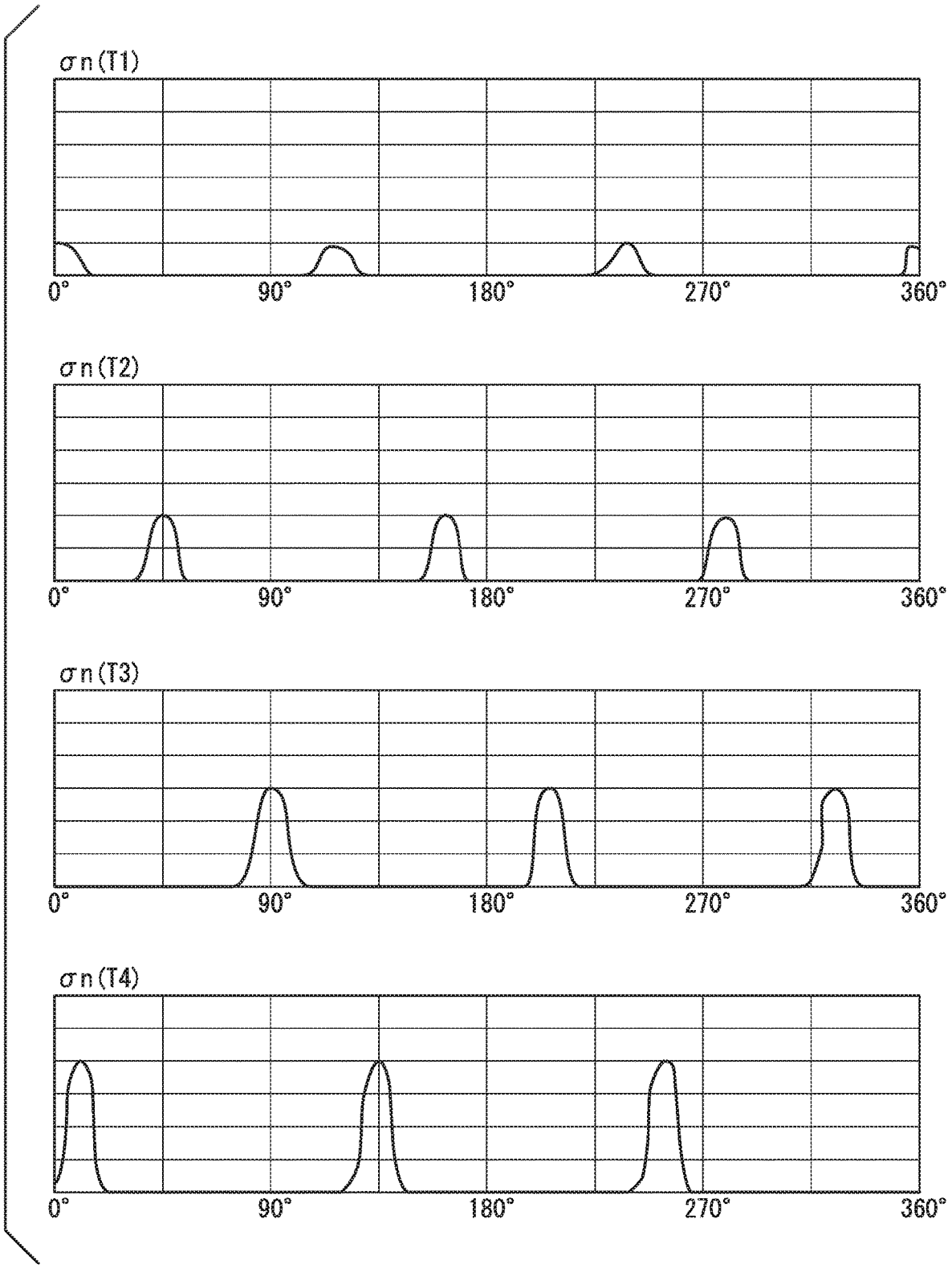
FIG. 13 relates to the hole widening method using the forming tool according to the third modified example and is a graph in which a relationship between the angular position of the forming tool and the index σn is shown in time series.

FIG. 13 shows a graph having the horizontal axis for the angular position and the vertical axis for the index σn regarding the working time points T1 to T4 in the hole widening method in a case of using the forming tool 10C according to the third modified example. As shown in this graph, in a case of using the forming tool 10C according to the third modified example, the number of peaks of the index σn can be three within the same cross section. Therefore, it is possible to further enhance the effect of preventing a stretch flange crack at the time of hole widening and the effect of reducing spring-back.

Figure 14A:
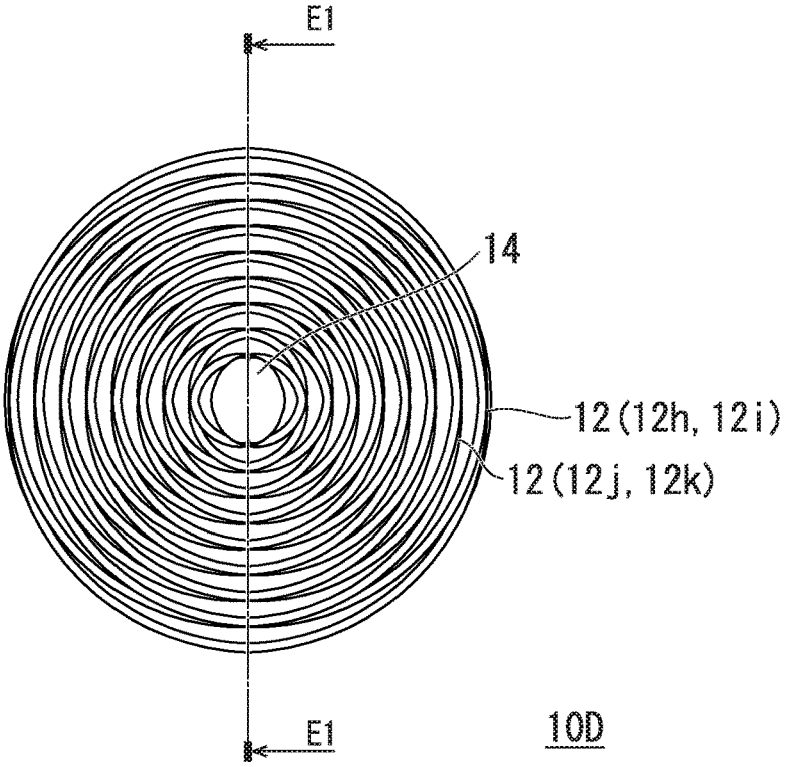
FIG. 14A is a plan view of a forming tool according to a fourth modified example.
Figure 14B:
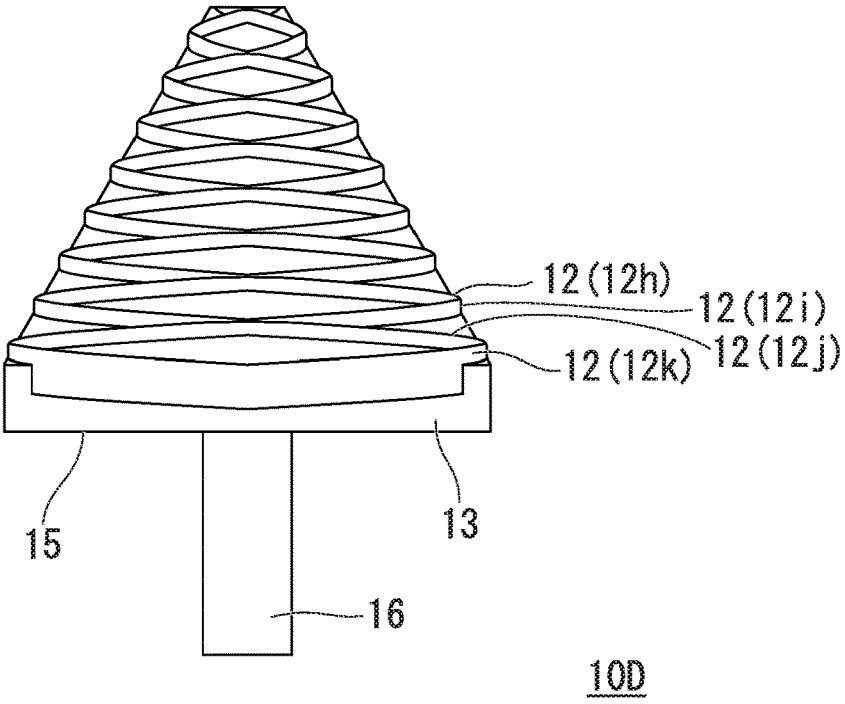
FIG. 14B is a side view of the same forming tool.
Figure 14C:
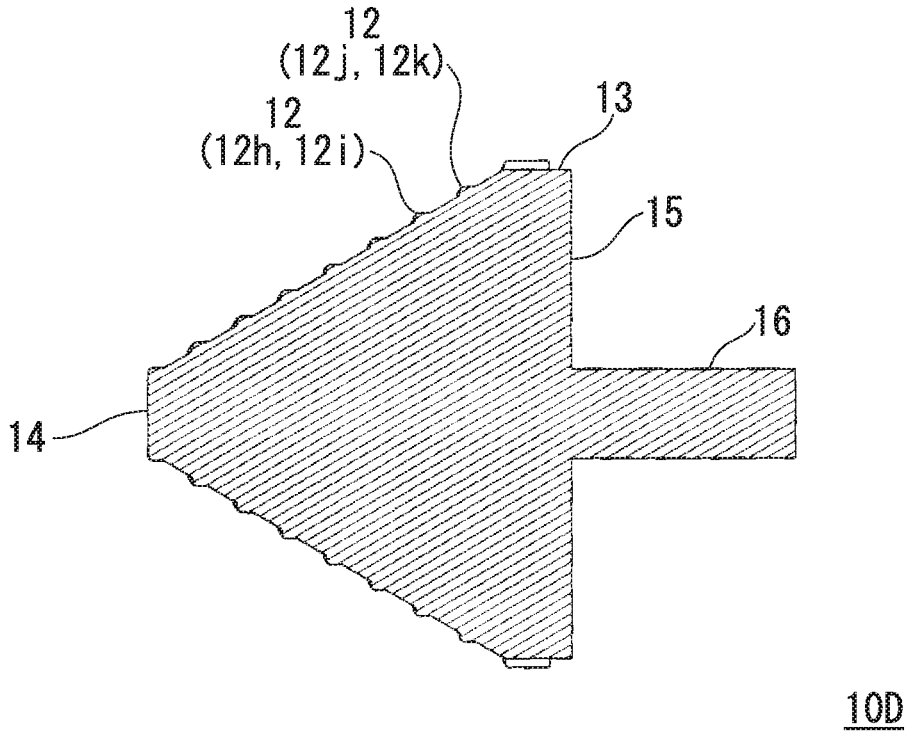
FIG. 14C is a cross-sectional view of the same forming tool obtained along line E1-E1 in FIG. 14A.

In a forming tool 10D according to a fourth modified example, as shown in FIGS. 14A to 14C, four line-shaped projections 12*h*, 12*i*, 12*j*, and 12*k* are spirally formed on a surface of the diameter-increasing portion 11 in directions by two opposite to each other. FIG. 14A is a plan view, FIG. 14B is a side view, and FIG. 14C is a cross-sectional view obtained along line E1-E1 in FIG. 14A.

Figure 15:
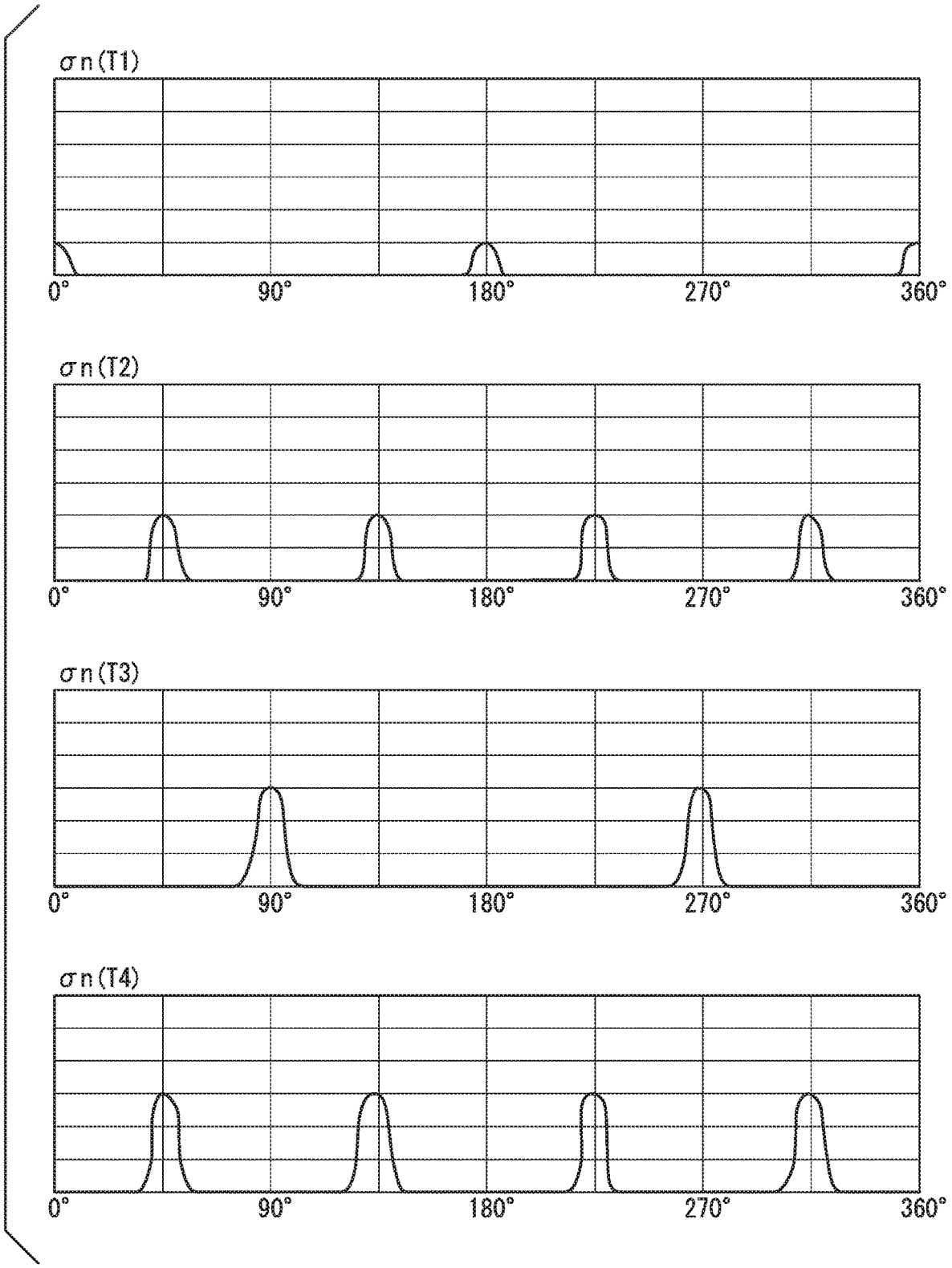
FIG. 15 relates to a hole widening method using the forming tool according to the fourth modified example and is a graph in which a relationship between the angular position of the forming tool and the index σn is shown in time series.

FIG. 15 shows a graph having the horizontal axis for the angular position and the vertical axis for the index σn regarding the working time points T1 to T4 in the hole widening method in a case of using the forming tool 10D according to the fourth modified example. As shown in this graph, in a case of using the forming tool 10D according to the fourth modified example, the number of peaks of the index σn can be four within the same cross section. Therefore, it is possible to further enhance the effect of preventing a stretch flange crack at the time of hole widening and the effect of reducing spring-back.

All of the forming tools 10 and 10A to 10D has a configuration in which a single or a plurality of the spirally line-shaped projections 12 are provided in the conical diameter-increasing portion 11. However, the essence of the present invention is that the pilot hole is successively pushed and widened due to a change in part of the circumferential edge portion of the pilot hole S1 in the steel sheet S with which the forming tool comes into contact, in accordance with relative movement of the forming tool with respect to the steel sheet S. That is, as long as the forming tool can realize this configuration, the forming tool is not particularly limited to a forming tool having a spirally line-shaped projection.

In a plan view of the forming tool seen from the front end side, if the forming tool has a shape such that the line-shaped projection is present in an arbitrary direction seen from the center, a part of the circumferential edge portion of the pilot hole S1 in the steel sheet S with which the forming tool comes into contact changes in accordance with movement of the forming tool, so that the pilot hole S1 can be successively pushed and widened. The shape of the stretched flange to be formed can change depending on the shape of the line-shaped projection provided in the forming tool. Therefore, the shape of the line-shaped projection may be suitably adjusted in accordance with the shape of the desired stretched flange. Therefore, it is possible to use forming tools 10E to 10G according to modified examples as shown in FIGS. 16A to 16C.

Figure 16A:
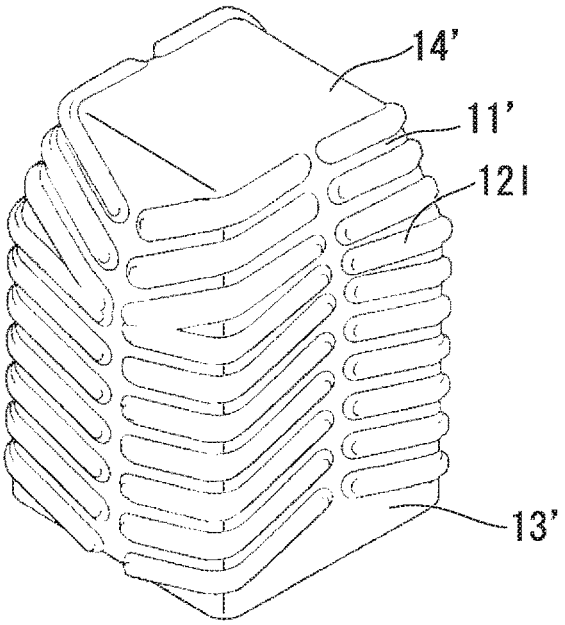
FIG. 16A is a perspective view of a forming tool according to a fifth modified example.
Figure 16B:
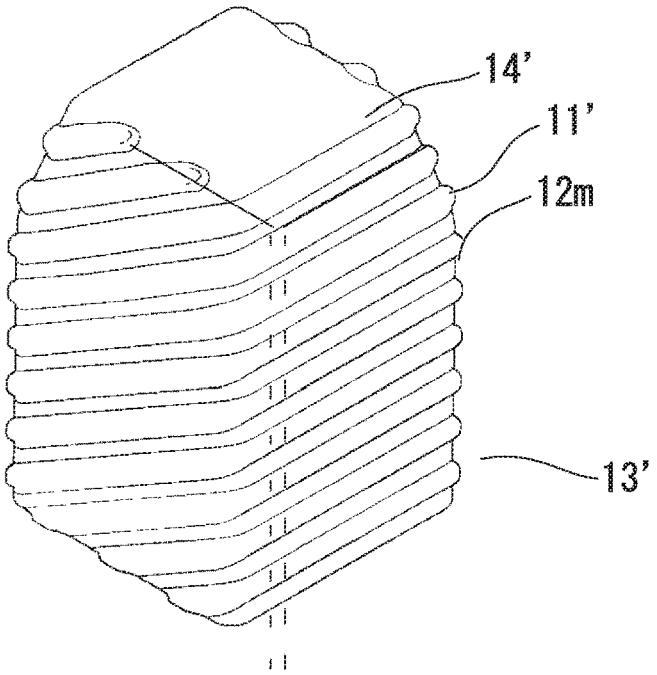
FIG. 16B is a perspective view of a forming tool according to a sixth modified example.
Figure 16C:
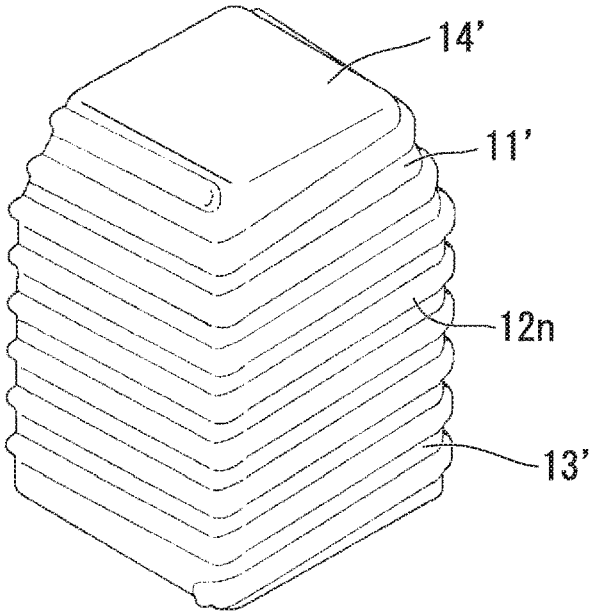
FIG. 16C is a perspective view of a forming tool according to a seventh modified example.

In the modified examples shown in FIGS. 16A to 16C, a diameter-increasing portion 11' having a truncated square pyramid shape is used as the diameter-increasing portion 11, a quadrangular prism-shaped body portion 13' provided in the rear end of the diameter-increasing portion 11' is used as the body portion 13, and a square apex portion 14' formed on the front end side of the diameter-increasing portion 11' is used as the apex portion 14.

In the forming tool 10E according to a fifth modified example, as shown in FIG. 16A, a plurality of disconnected line-shaped projections 12*l* are formed on surfaces of the diameter-increasing portion 11' and the body portion 13' such that the line-shaped projections 12*l* are inclined with respect to the axial direction of the forming tool 10E.

In the forming tool 10F according to a sixth modified example, as shown in FIG. 16B, a plurality of line-shaped projections 12*m* are formed parallel to one another on surfaces of the diameter-increasing portion 11' and the body portion 13' such that that line-shaped projections 12*m* are inclined with respect to the axial direction of the forming tool 10F. In this modified example, since the line-shaped projection 12*m* formed on the corner portion is inclined with respect to the axial direction of the forming tool 10F, the effect of the present invention can be achieved.

In the forming tool 10G according to a seventh modified example, as shown in FIG. 16C, a single line-shaped projection 12*n* is spirally provided on surfaces of the diameter-increasing portion 11' and the body portion 13'.

In the forming tools 10E, 10F, and 10G according to the fifth to seventh modified examples shown in FIGS. 16A to 16C as well, similar to the forming tool 10, the pilot hole S1 is successively pushed and widened due to a change in a part of the circumferential edge portion of the pilot hole S1 in the steel sheet S with which the line-shaped projections 12*l*, 12*m*, and 12*n* come into contact, in accordance with relative movement of the forming tools 10E to 10G with respect to a metal material. Accordingly, the location to which tensile stress is applied becomes a part of the circumferential edge portion. Furthermore, in the location, tensile stress is released before necking is caused, and tensile stress is applied to a different location. Therefore, even if a force is applied, the force is released before distortion such as elongation, occurrence of necking, and breaking progresses, and the pilot hole returns to the state before being distorted. Thus, a stretch flange crack at the time of hole widening can be suppressed.

In the hole widening method according to the present embodiment, the pilot hole may be widened by pushing the forming tool into the pilot hole while the forming tool is rotating about the central axis in a pushing direction. In such a case, it is preferable in that the number of times the line-shaped projection 12 abuts the pilot hole can be adjusted through a single press. That is, as shown in FIGS. 5A and 5B, in a case where the forming tool is pushed without rotating, the number of times of contact of the line-shaped projection in a predetermined angular position of the pilot hole is approximately four. However, in a case where the forming tool 10 is pushed while the forming tool 10 rotates, the number of times of contact thereof can be increased or reduced in accordance with the rotation frequency.

In this manner, in a case where the pilot hole S1 in the steel sheet S is widened while the forming tool 10 rotates, the position of the circumferential edge portion of the pilot hole S1 in the steel sheet S to be in contact with the forming tool 10 successively changes due to the rotation. Therefore, there is no need to spirally provide the line-shaped projection 12 or to provide a plurality of line-shaped projections 12 at equal intervals in the circumferential direction of the forming tool 10.

Figure 17A:
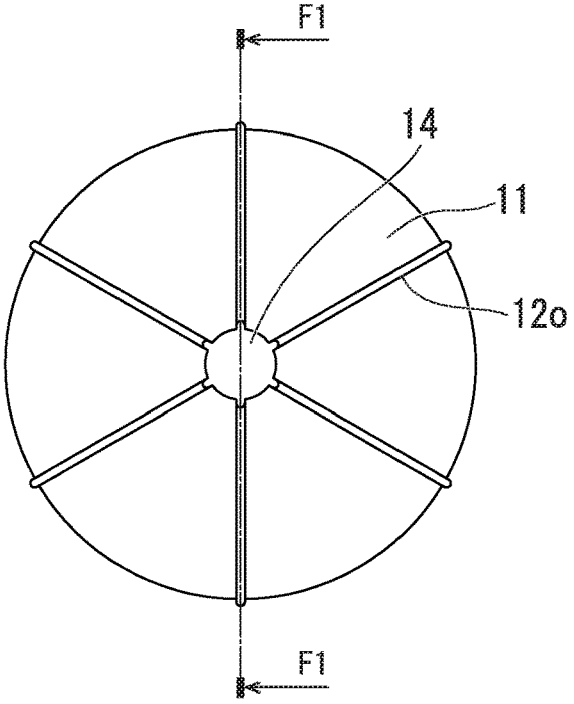
FIG. 17A is a plan view of a forming tool according to an eighth modified example.
Figure 17B:
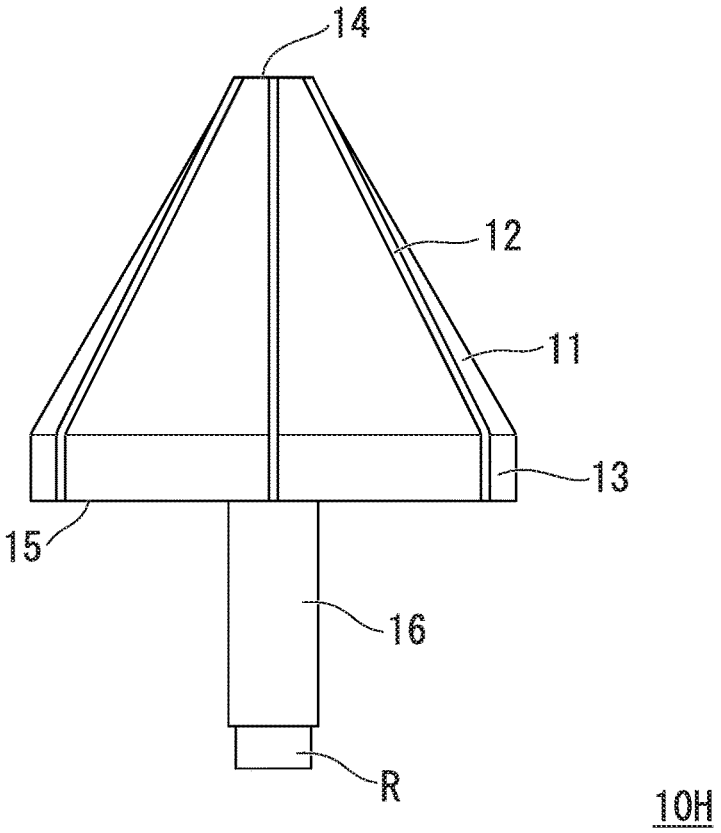
FIG. 17B is a side view of the same forming tool.
Figure 17C:
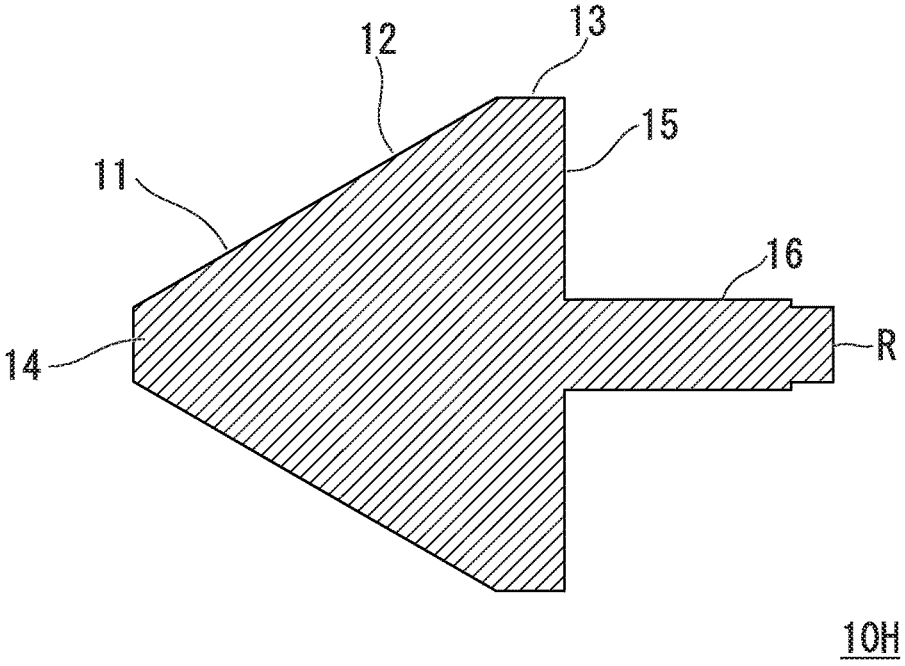
FIG. 17C is a cross-sectional view of the same forming tool obtained along line F1-F1 in FIG. 17A.

Therefore, for example, it is possible to use a forming tool 10H according to an eighth modified example as shown in FIGS. 17A to 17C.

In this forming tool 10H, six line-shaped projections 12*o* are linearly formed in the diameter-increasing portion 11, and a rotation mechanism R for rotating the forming tool 10H is provided in the gripping portion 16. This rotation mechanism R rotates the forming tool 10H in accordance with relative movement of the forming tool 10H with respect to the steel sheet S. The rotation mechanism R only needs to be able to rotate the line-shaped projection 12*o* and is not limited to the form of being provided in the gripping portion 16.

Figure 18:
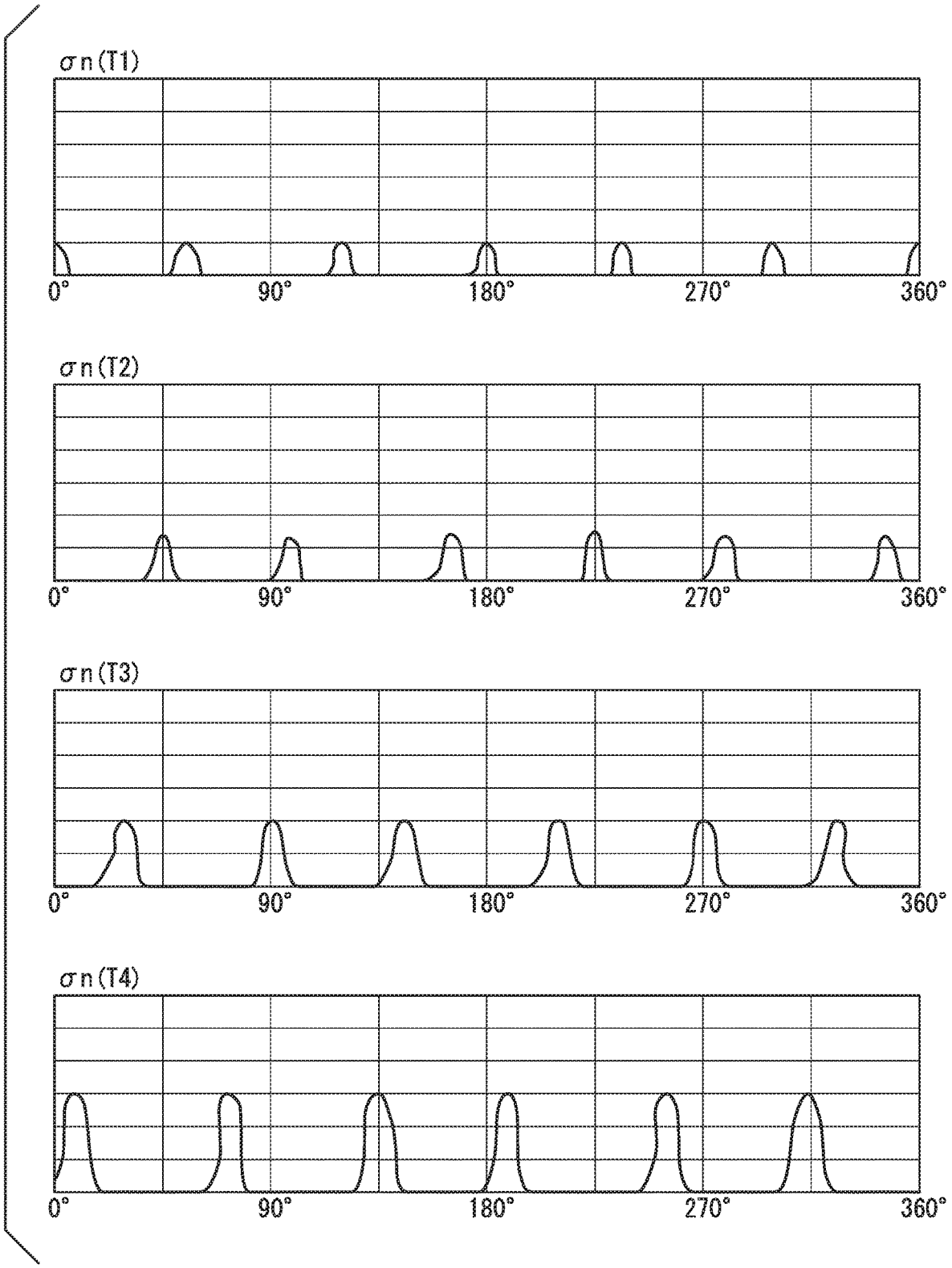
FIG. 18 relates to a hole widening method using the forming tool according to the eighth modified example and is a graph in which a relationship between the angular position of the forming tool and the index σn is shown in time series.

FIG. 18 shows a graph having the horizontal axis for the angular position and the vertical axis for the index σn regarding the working time points T1 to T4 in a working method of widening the pilot hole while the forming tool 10H according to the eighth modified example rotates. As shown in this graph, in the working method of widening the pilot hole while the forming tool 10H according to the eighth modified example rotates, the linearly line-shaped projection 12*o* is provided in the diameter-increasing portion 11 such that the forming tool 10H comes into contact with a part of the pilot hole S1 in the steel sheet S. Thereafter, the location of the circumferential edge portion of the pilot hole S1 to be in contact with the forming tool moves in accordance with hole widening by rotating the forming tool 10H in accordance with relative movement of the forming tool 10H with respect to the steel sheet S.

That is, the location to which tensile stress is applied becomes a part of the circumferential edge portion. Furthermore, in the location, tensile stress is released before necking is caused, and tensile stress is applied to a different location. Therefore, even if a force is applied, the force is released before distortion such as elongation, occurrence of necking, and breaking progresses, and the pilot hole returns to the state before being distorted. Thus, a stretch flange crack at the time of hole widening can be suppressed.

In a case or rotating the forming tool 10H, the moving speed of the peak of the index σn within the same cross section can be adjusted by controlling the rotation frequency. Therefore, it is possible to employ an appropriate rotation speed in accordance with material characteristics of the steel sheet S by using a single forming tool 10H, so that it is possible to reliably enhance an effect of preventing a stretch flange crack at the time of hole widening and an effect of reducing spring-back. Furthermore, since punch and stroke of the forming tool 10H can be shortened, there is an advantage in that a large-sized press machine no longer needs to be used.

The forming tool 10 used in the hole widening method according to the present embodiment has the body portion 13. However, the body portion 13 is not essential, and the gripping portion 16 may be directly provided on the bottom surface of the diameter-increasing portion 11.

However, in a case of having the body portion 13, it is preferable in that particularly the front end section of the stretched flange during working is pushed and widened and burring of uniformly straightening the inner diameter of the stretched flange can be performed.

In a case where the forming tool 10 has the body portion 13, the line-shaped projection 12 may be continuously provided to the body portion 13 lead from the diameter-increasing portion 11. That is, it is possible to use a forming tool 10I according to a ninth modified example shown in FIGS. 19A to 19C, a forming tool 10J according to an eleventh modified example shown in FIGS. 20A to 20C, and a forming tool 10K according to a twelfth modified example shown in FIGS. 21A to 21C.

Figure 19A:
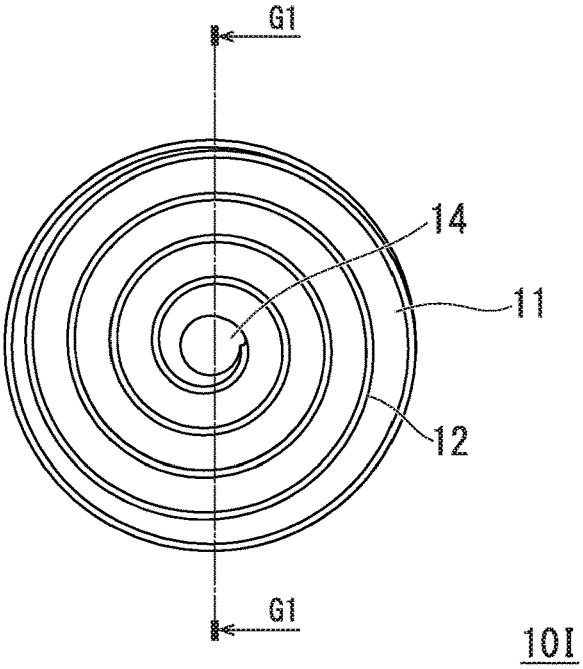
FIG. 19A is a plan view of a forming tool according to a ninth modified example.
Figure 19B:
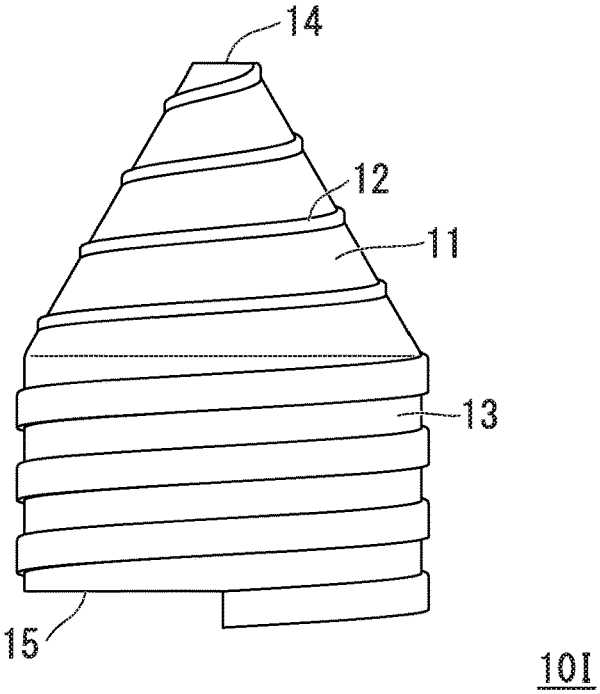
FIG. 19B is a side view of the same forming tool.
Figure 19C:
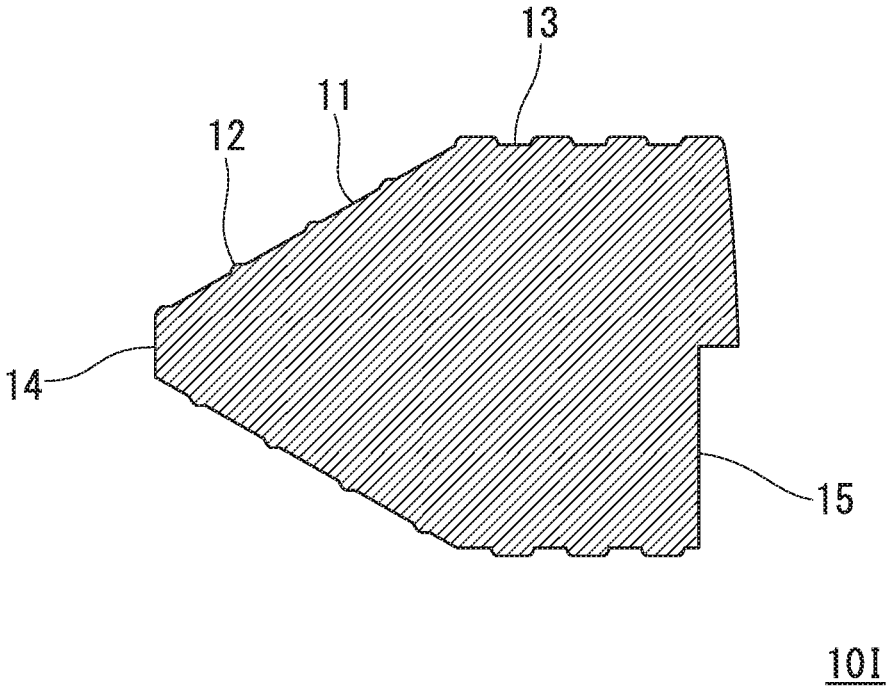
FIG. 19C is a cross-sectional view of the same forming tool obtained along line G1-G1 in FIG. 19A.

In the forming tool 10I according to the ninth modified example, as shown in FIGS. 19A to 19C, the line-shaped projection 12 is continuously formed in a spiral state even on a surface of the body portion 13.

FIG. 19A is a plan view, FIG. 19B is a side view, and FIG. 19C is a cross-sectional view obtained along line G1-G1 in FIG. 19A.

Figure 20A:
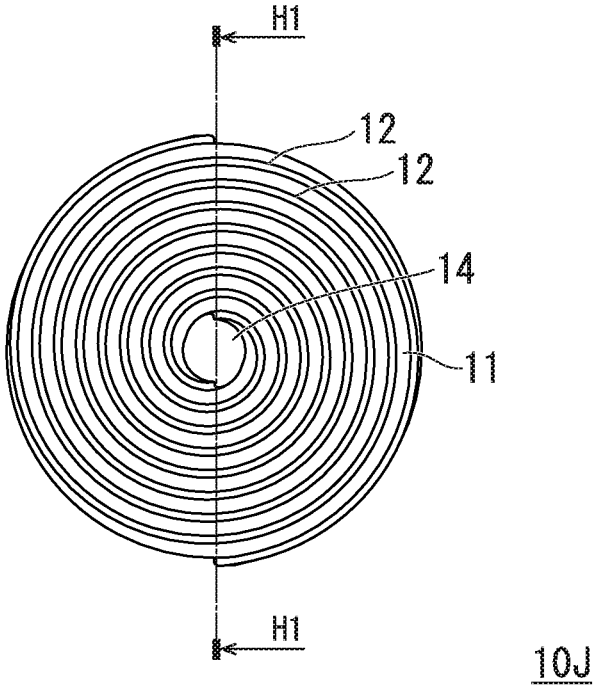
FIG. 20A is a plan view of a forming tool according to a tenth modified example.
Figure 20B:
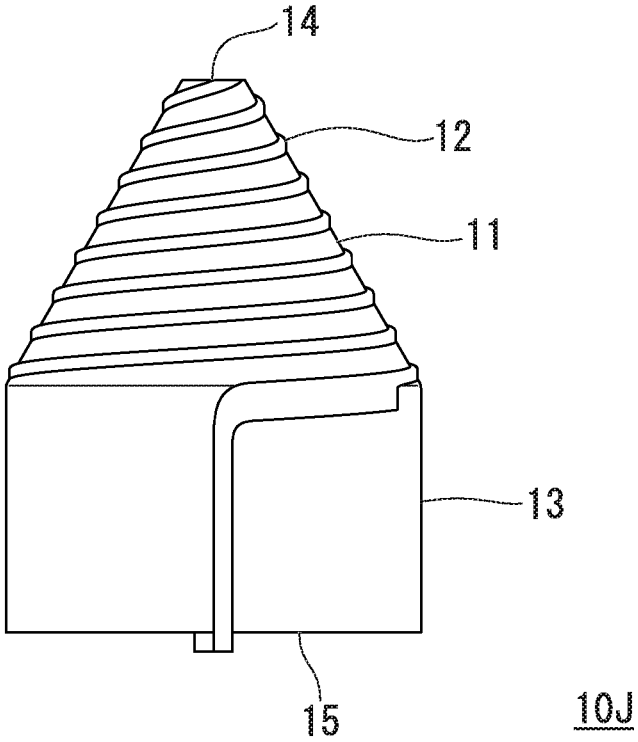
FIG. 20B is a side view of the same forming tool.
Figure 20C:
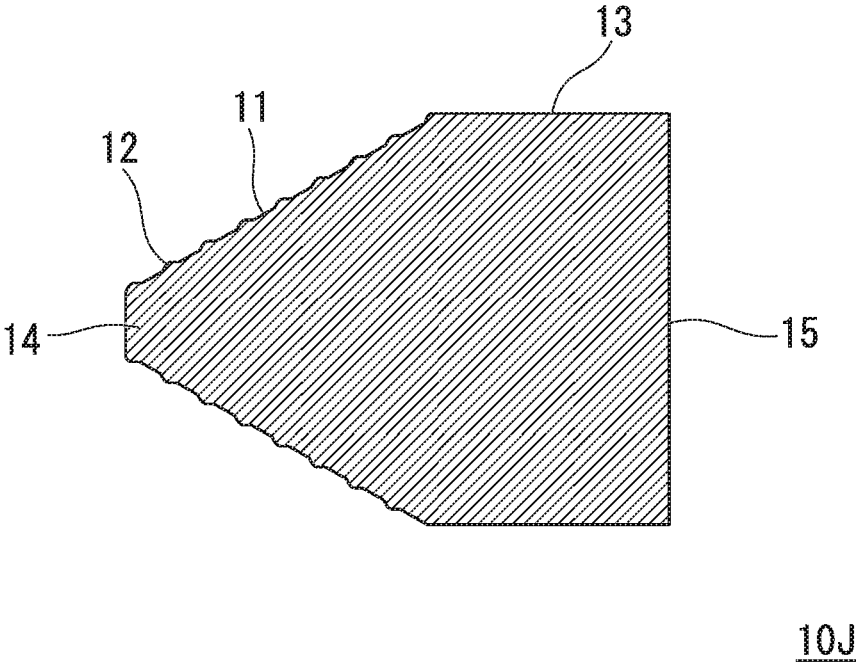
FIG. 20C is a cross-sectional view of the same forming tool obtained along line H1-H1 in FIG. 20A.

In the forming tool 10J according to the tenth modified example, as shown in FIGS. 20A to 20C, the line-shaped projection 12 is continuously formed in a linear state parallel to the axial direction of the forming tool 10J on a surface of the body portion 13.

FIG. 20A is a plan view, FIG. 20B is a side view, and FIG. 20C is a cross-sectional view obtained along line H1-H1 in FIG. 20A.

Figure 21A:
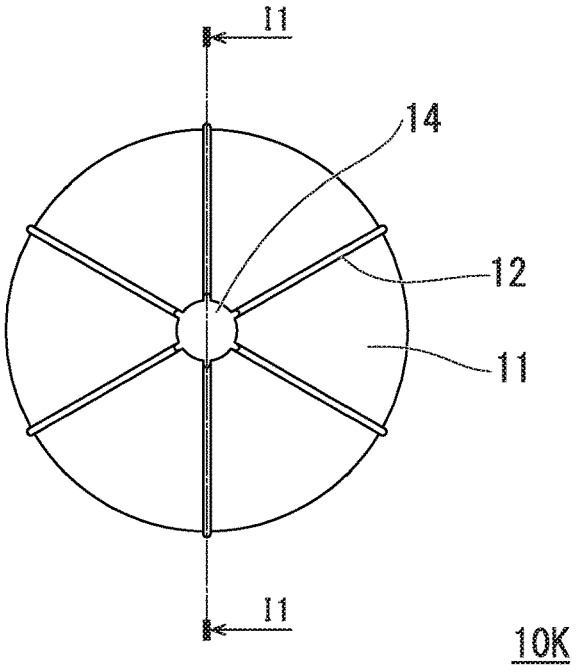
FIG. 21A is a plan view of a forming tool according to an eleventh modified example.
Figure 21B:
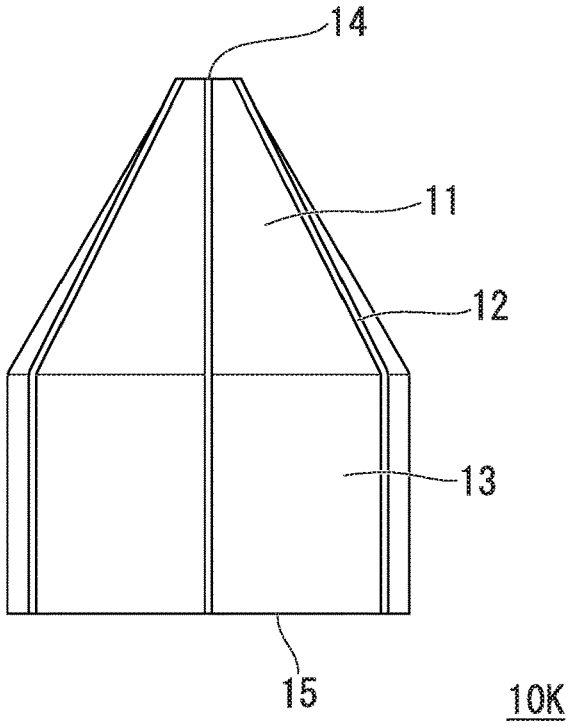
FIG. 21B is a side view of the same forming tool.
Figure 21C:
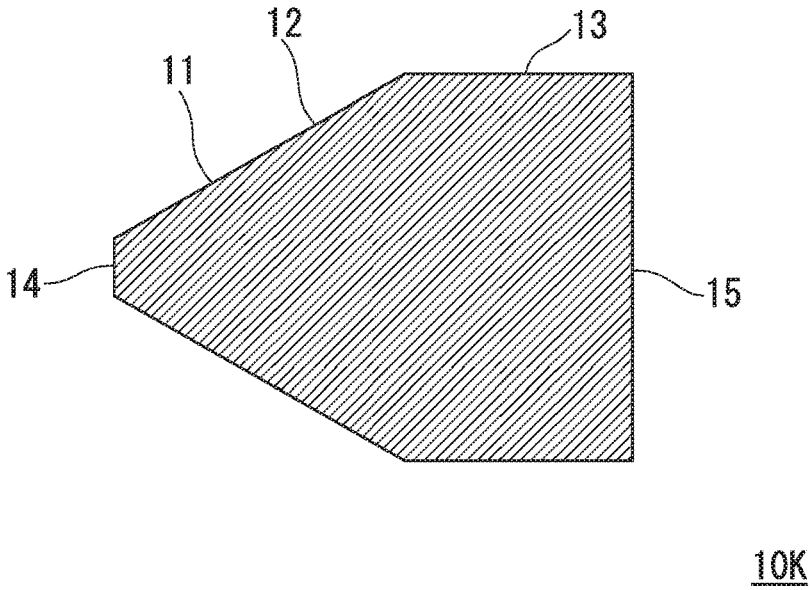
FIG. 21C is a cross-sectional view of the same forming tool obtained along line I1-I1 in FIG. 21A.

In the forming tool 10K according to the eleventh modified example, as shown in FIGS. 21A to 21C, the line-shaped projection 12 linearly formed in the diameter-increasing portion 11 is formed to extend to the body portion 13.

FIG. 21A is a plan view, FIG. 21B is a side view, and FIG. 21C is a cross-sectional view obtained along line I1-I1 in FIG. 21A.

As shown in the ninth modified example to the eleventh modified example, in a case where the line-shaped projection 12 is formed to the body portion, the contact area between the pilot hole S1 after working ends and the forming tool 10I, 10J, or 10K is reduced. Therefore, in addition to an effect of facilitating release due to reduction of spring-back, it is possible to achieve an effect of further facilitating release.

Figure 22A:
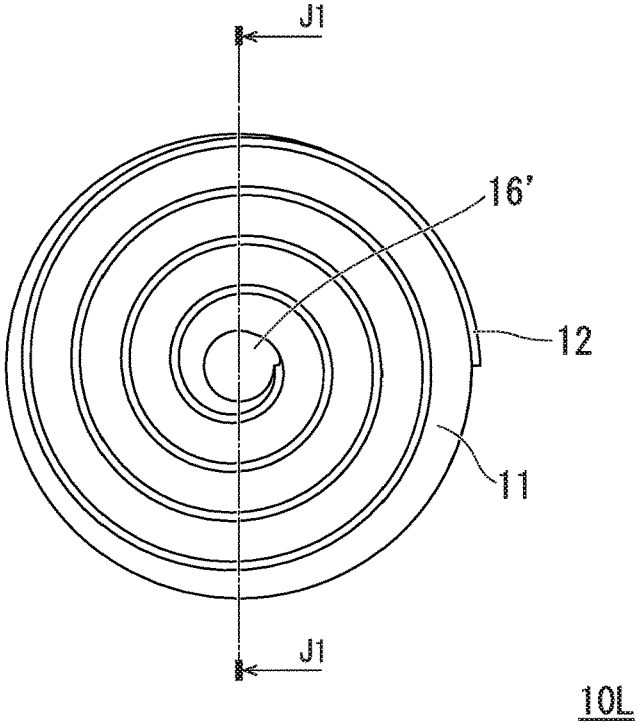
FIG. 22A is a plan view of a forming tool according to a twelfth modified example.
Figure 22B:
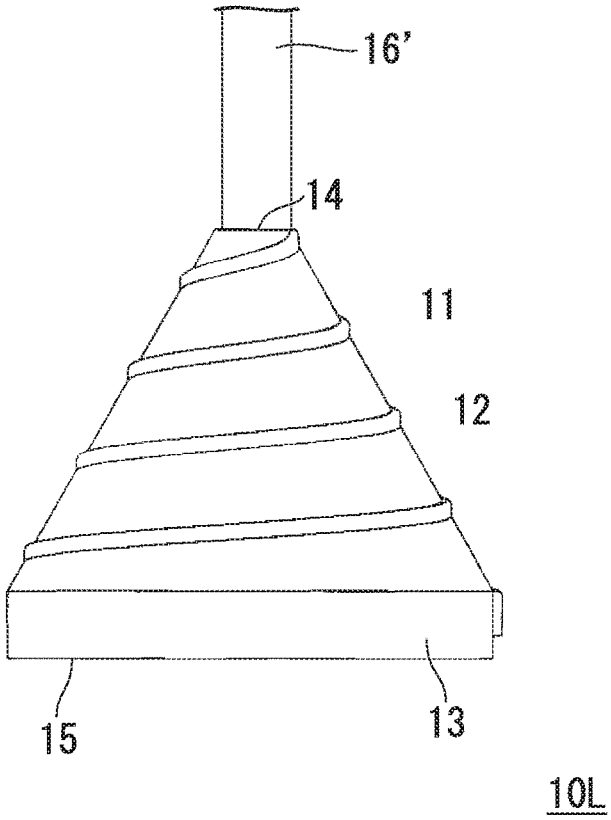
FIG. 22B is a side view of the same forming tool.
Figure 22C:
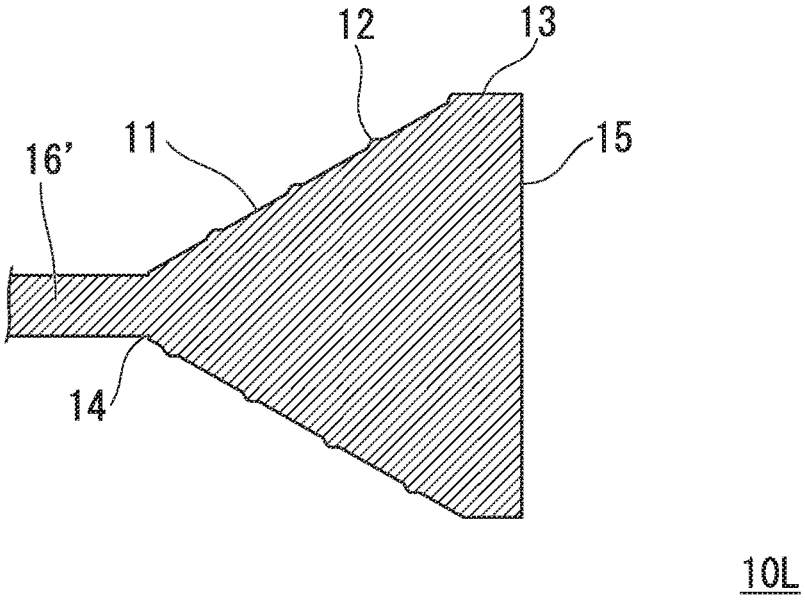
FIG. 22C is a cross-sectional view of the same forming tool obtained along line J1-J1 in FIG. 22A.
Figure 23A:
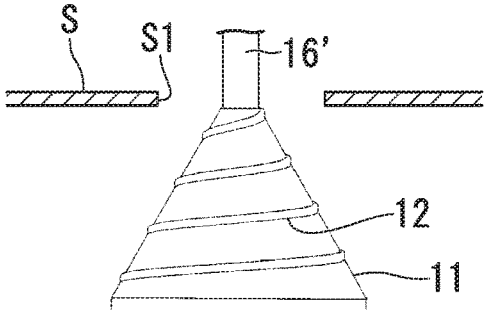
FIG. 23A is a cross-sectional view showing a state before hole widening in the hole widening method using the same forming tool.
Figure 23B:
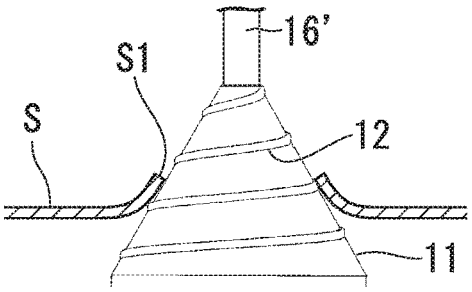
FIG. 23B is a cross-sectional view showing a state at the time of completion of hole widening in the hole widening method using the same forming tool.

The hole widening method according to the present embodiment has been described with reference to a case where hole widening is performed by pushing the gripping portion 16 using the forming tool 10 in which the gripping portion 16 is provided on the rear end side, that is, the bottom portion 15. However, as described in a twelfth modified example shown in FIGS. 22A to 22C, hole widening may be performed by drawing the gripping portion 16' toward the pilot hole using a forming tool 10L in which a gripping portion 16' is provided in the apex portion 14.

The time required for hole widening performed through press forming is approximately one second. Although it is a short time from a viewpoint of productivity, the time is not so short in consideration from a viewpoint of a distortion speed of a material. That is, it is assumed that the working time such as one second is a time sufficient for changes such as applying tensile stress to the steel sheet S during working, releasing the force before necking is caused, and returning to the state before being distorted.

In addition, if the number of times the line-shaped projection 12 comes into contact with the same location in the pilot hole S1 is two times or more, loading and releasing tensile stress in the location can be repeated a plurality of times. Therefore, it is possible to achieve an effect of preventing a stretch flange crack at the time of hole widening and an effect of reducing spring-back.

However, in a case where the number of times the line-shaped projection 12 comes into contact with the same location in the pilot hole S1 exceeds 10 times, the interval of repeating loading and releasing tensile stress becomes short, and it is difficult to achieve the effect described above. Therefore, it is preferable that the number of times the line-shaped projection 12 comes into contact with the same location in the pilot hole S1 is 10 times or less.

Hereinabove, specific examples of the present invention have been described based on the embodiment and the modified examples of the present invention. However, the present invention is not limited to these examples. The present invention includes various modifications and changes of the specific examples described above.

The workpiece plate is not limited to a steel sheet. It is possible to use a metal plate such as an aluminum plate and a titanium plate, a glass-fiber reinforced resin plate such as FRP and FRTP, and a composite plate thereof.

In addition, a hollow tube member such as a steel tube may be adopted as a workpiece plate.

As a cross-sectional shape of the line-shaped projection 12, shapes other than a semicircle can be employed. However, since the line-shaped projection 12 is an element for forming a stretched flange through hole widening, it is preferable that the location which comes into contact with the circumferential edge portion of the pilot hole does not have an acute angle portion.

As the cross-sectional shape of the line-shaped projection 12, it is preferable that at least a location which comes into contact with the circumferential edge portion of the pilot hole has an arc shape of which the radius of curvature is 0.1 mm or greater.

The protrusion height of the line-shaped projection 12 does not vary due to the relationship with respect to the dimensions of the pilot hole. However, the protrusion height may be formed to be gradually reduced from the front end side toward the rear end side.

The inclination of the diameter-increasing portion 11 does not have to be uniform from the front end section to the rear end section, and the inclination may vary in the middle. The forming tool may have a shape in which the diameter gently varies between the diameter-increasing portion 11 and the body portion 13.

The apex portion 14 formed on the front end side of the diameter-increasing portion 11 is not necessarily a flat surface. The apex portion 14 may be a curved surface.

The shape of the pilot hole S1 is not limited to a circle or a square. The shape thereof may be an elliptical shape or a different polygonal shape.

In addition, a projected shape of the forming tool 10 in a plan view is not limited to a circle or a square. The projected shape thereof may also be an elliptical shape or a different polygonal shape.

EXAMPLE A

An experiment was performed in order to check for an effect of preventing a stretch flange crack at the time of hole widening and an effect of reducing spring-back according to the present invention. As the steel sheet S (workpiece), a high strength hot rolled steel sheet of 780 MPa having the sheet thickness of 2.4 mm was prepared.

Pilot holes of various sizes and shapes were provided in the steel sheet S in advance through punching. Hole widening was performed by pushing various forming tools against the pilot holes at the speed of 10 mm/sec.

As the evaluation for a stretch flange crack at the time of hole widening, the sizes of the pilot holes were reduced in the unit of 1 mm with respect to each of Examples of the invention having the line-shaped projection and Comparative Examples having no line-shaped projection, and evaluation was conducted based on the smallest size of the pilot hole in which no stretch flange crack was caused.

In regard to spring-back, since it was unfair if the sizes of the pilot holes did not match each other between Examples of the present invention and Comparative Examples, and since spring-back could not be evaluated in a case where a stretch flange crack was caused, hole widening was performed with respect to each of Examples of the invention and Comparative Examples for the size of the pilot hole at which a stretch flange crack was caused in Comparative Example, and the ratio of the cross-sectional area of the forming tool and the hole area was evaluated as a K-value (K-value=hole area after release/projected area of forming tool in plan view).

Tables 1 to 3 show the shapes of the forming tools used in various experimental examples, the dimensions of the forming tools, the dimensions of the pilot holes, the rotation speeds, the dimensions of the pilot holes in which a stretch flange crack was caused, the K-values, and the evaluation results of release characteristics.

TABLE 1

| | Shape of forming tool | Dimensions of forming tool | Dimensions of pilot hole | Rotation speed | Dimensions of pilot holes in which stretch flange crack caused | K-value | Evaluation of release characteristics |
|---|---|---|---|---|---|---|---|
| Example 1-1 of invention | FIG. 4B | Circle having diameter of 60 mm | Reduced in unit of 1 mm from diameter of 60 mm | 0 times/sec | Circle having diameter of 35 mm | 95% | Good |
| Example 1-2 of invention | FIG. 12B | | | | Circle having diameter of 31 mm | 99% | Very Good |
| Comparative Example 1 | Line-shaped projection in FIGS. 4B and 12B removed | | | | Circle having Diameter of 50 mm | 88% | Bad |

TABLE 2

| | Shape of forming tool | Dimensions of forming tool | Dimensions of pilot hole | Rotation speed | Dimensions of pilot holes in which stretch flange crack caused | K-value | Evaluation of release characteristics |
|---|---|---|---|---|---|---|---|
| Example 2-1 of invention | FIG. 16A | Square having one side of 30 mm (radius of curvature of corner portion is 5 mm) | Reduced in unit of 1 mm from one side of 30 mm (radius of curvature of corner portion is 5 mm) | 0 times/sec | Square having one side of 22 mm | 94% | Good |
| Example 2-2 of invention | FIG. 16B | | | | Square having one side of 23 mm | 93% | Good |
| Example 2-3 of invention | FIG. 16C | | | | Square having one side of 21 mm | 95% | Good |
| Comparative Example 2 | Line-shaped projection in FIGS. 16A to 16C removed | | | | Square having one side of 28 mm | 85% | Bad |

TABLE 3

| | Shape of forming tool | Dimensions of forming tool | Dimensions of pilot hole | Rotation speed | Dimensions of pilot holes in which stretch flange crack caused | K-value | Evaluation of release characteristics |
|---|---|---|---|---|---|---|---|
| Example 3-1 of invention | FIG. 17B | Circle having diameter of | Reduced in unit of 1 mm from | 8 times/sec | Circle having diameter of 30 mm | 97% | Good |

TABLE 3-continued

| | Shape of forming tool | Dimensions of forming tool | Dimensions of pilot hole | Rotation speed | Dimensions of pilot holes in which stretch flange crack caused | K-value | Evaluation of release characteristics |
|---|---|---|---|---|---|---|---|
| Example 3-2 of invention | FIG. 21B | 60 mm | diameter of 55 mm | | Circle having diameter of 30 mm | 98% | Very Good |
| Comparative Example 3-1 | Line-shaped projection in FIG. 17B removed | | | | Circle having diameter of 48 mm | 88% | Bad |
| Comparative Example 3-2 | Line-shaped projection in FIG. 21B removed | | | | Circle having diameter of 48 mm | 88% | Bad |

In Example 1-1 of the invention, a forming tool having one line-shaped projection shown in FIG. 4B was used. In Example 1-2 of the invention, a forming tool having three line-shaped projections shown in FIG. 12B was used.

In Comparative Example 1, a forming tool, that is, the forming tool shown in FIG. 4B or 12B, from which the line-shaped projection was removed, was used.

As shown in Table 1, in a case of Comparative Example 1 having no line-shaped projection, a stretch flange crack was caused in a case where the dimensions of the pilot hole were 50 mm. Meanwhile, in Example 1-1 of the invention and Example 1-2 of the invention having a line-shaped projection, a stretch flange crack was caused in a case where the dimensions of the pilot holes were 35 mm and 31 mm respectively. That is, it could be checked that an excellent effect of suppressing a crack could be achieved by providing a line-shaped projection.

Furthermore, in Example 1-1 of the invention and Example 1-2 of the invention, high K-values could be obtained compared to Comparative Example 1. That is, it could be checked that an excellent effect of suppressing spring-back could be achieved by providing a line-shaped projection.

Furthermore, in cases of Example 1-1 of the invention and Example 1-2 of the invention, since spring-back was reduced, when the forming tool was pulled out, there was no occurrence of a situation in which a hole edge portion of the steel sheet S was stuck on the forming tool and was unlikely to be separated. That is, improvement in release characteristics was also recognized.

In Example 2-1 of the invention, the forming tool shown in FIG. 16A was used. In Example 2-2 of the invention, the forming tool shown in FIG. 16B was used. In Example 2-3 of the invention, the forming tool shown in FIG. 16C.

In Comparative Example 2, a forming tool, that is, the forming tool shown in FIG. 16A, 16B, or 16C, from which the line-shaped projection was removed, was used.

As shown in Table 2, even in a case of using a forming tool which had a diameter-increasing portion having a truncated square pyramid shape, it could be checked that an excellent effect of suppressing a crack and an effect of reducing spring-back could be exhibited by having a line-shaped projection.

Furthermore, in cases of Example 2-1 of the invention, Example 2-2 of the invention, and Example 2-3 of the invention, since spring-back was reduced, when the forming tool was pulled out, there was no occurrence of a situation in which a hole edge portion of the steel sheet S was stuck on the forming tool and was unlikely to be separated. That is, improvement in release characteristics was also recognized.

In Example 3-1 of the invention, the forming tool shown in FIG. 17B was used. In Example 3-2 of the invention, the forming tool shown in FIG. 21B was used. Hole widening was performed while the forming tool was rotating, by transmitting a drive force of a motor embedded in the forming tool to the gripping portion of the forming tool by means of a gear transmission mechanism.

In Comparative Example 3-1 and Comparative Example 3-2, a forming tool, that is, the forming tool shown in FIG. 17B or FIG. 21B, from which the line-shaped projection was removed, was used. Hole widening was performed while the forming tool was rotating, by transmitting a drive force of a motor embedded in the forming tool to the gripping portion of the forming tool by means of a gear transmission mechanism.

As shown in Table 3, even in a case of using a forming tool which had a linearly line-shaped projection, it could be checked that an excellent effect of suppressing a crack and an effect of reducing spring-back could be exhibited by performing hole widening while the forming tool was rotating.

Furthermore, in cases of Example 3-1 of the invention and Example 3-2 of the invention, since spring-back was reduced, when the forming tool was pulled out, there was no occurrence of a situation in which a hole edge portion of the steel sheet S was stuck on the forming tool and was unlikely to be separated. That is, improvement in release characteristics was also recognized. Particularly, in Example 3-2 of the invention, since a line-shaped projection was provided in the body portion as well, more excellent release characteristics could be achieved.

EXAMPLE B

An experiment was performed in order to check for an influence of the number of threads and the pitch of the line-shaped projection of the forming tool on an effect of preventing a stretch flange cracks at the time of hole widening and an effect of reducing spring-back.

Hole widening was performed based on the forming tool of the examples of the present invention shown in FIGS. 4A to 4C, while the spiral angle was fixed to 45 degrees and the number of threads of the line-shaped projection was varied.

Here, a numerical value index δ at which successive forming can be appropriately performed with the line-shaped projection is defined as follows. When the index σn has an absolute maximum value σmax and an absolute minimum value σmin in a case where distribution of the index σn is observed at a certain time, the index cm is defined as follows.

$$\delta=|\sigma max-\sigma min|/\sigma max$$

As the factor δ described above, it is possible to employ a value within a range of $0.0<\delta<1.0$. When $\delta=0.0$, σmax=σmin is established. Therefore, since there is no occurrence of difference between the ridge and the valley of the index σn, there is no occurrence of partial contact between the forming tool and the steel sheet S, so that successive forming is not executed. When $\delta=1.0$, σmin=0.0 MPa is established, thereby indicating that partial contact is conducted in a location where the index σn=σmax is established. From the above, as δ is closer to 1.0, the partial contact occurs and successive forming is appropriately performed. In addition, as δ is closer to 0.0, it indicates that continuous contact occurs in a wide range and working falls short of successive forming.

Figure 24:
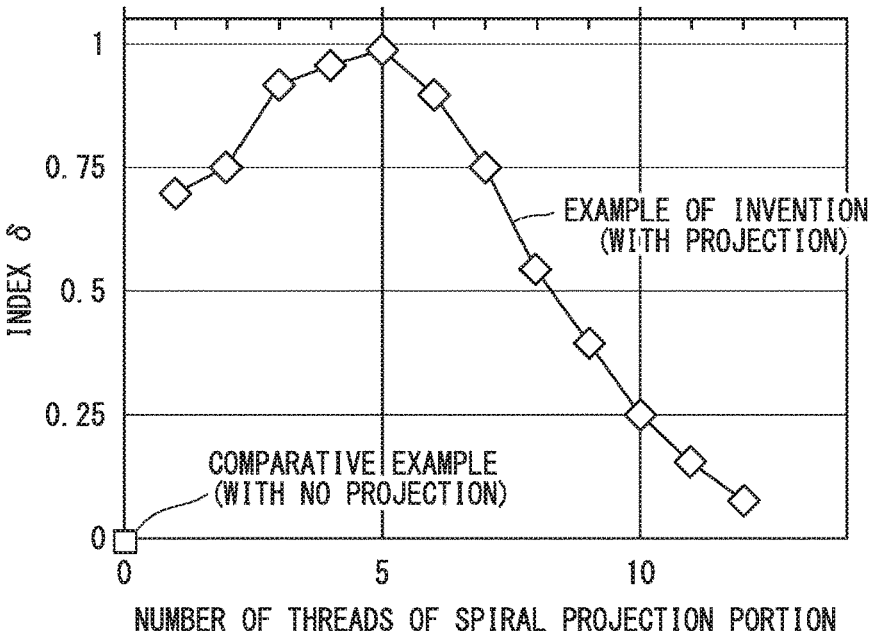
FIG. 24 is a graph having a horizontal axis for the number of threads of the line-shaped projection and a vertical axis for an index σ.

FIG. 24 shows a change in the index δ when hole widening is performed using the forming tool of which the number of threads ranges zero to 12. In a case of performing burring forming by means of the forming tool of which the number of threads was zero, that is, the forming tool according to Comparative Example, the equal index σn was effectuated throughout the entire region of the hole edge. Therefore, $\delta=0.0$ was established.

In the successive burring forming tool, when the line-shaped projection was provided even by one thread, a high value of $\delta>0.70$ or higher was employed. However, at this shape level of the forming tool, there were cases where contact occurred even on the base surface (conical surface) other than the line-shaped projection in the cases of one spiral thread and two spiral threads, and the value remained lower than $\delta=1.0$.

When the number of spiral threads was greater than three, multiple point contact was ideally realized and successive forming was performed, thereby being close to $\delta=1.0$. When the number of threads was increased, δ decreased. It denotes that when the contact point increases, the σmin which is a non-zero value comes close to the value of σmax and sufficient valleys are not formed in the distribution of the index σn so that successive forming is not sufficiently exhibited.

From the above, when the number of spiral threads, that is, the number of contact points becomes excessively great, successive forming cannot be sufficiently realized. In addition, when the number of spiral threads becomes excessively small, divergence is recognized from the postulated condition of successive forming causing contact other than the line-shaped projection. That is, the number of contact parts which can perform successive forming is limited to a certain range.

Figure 25:
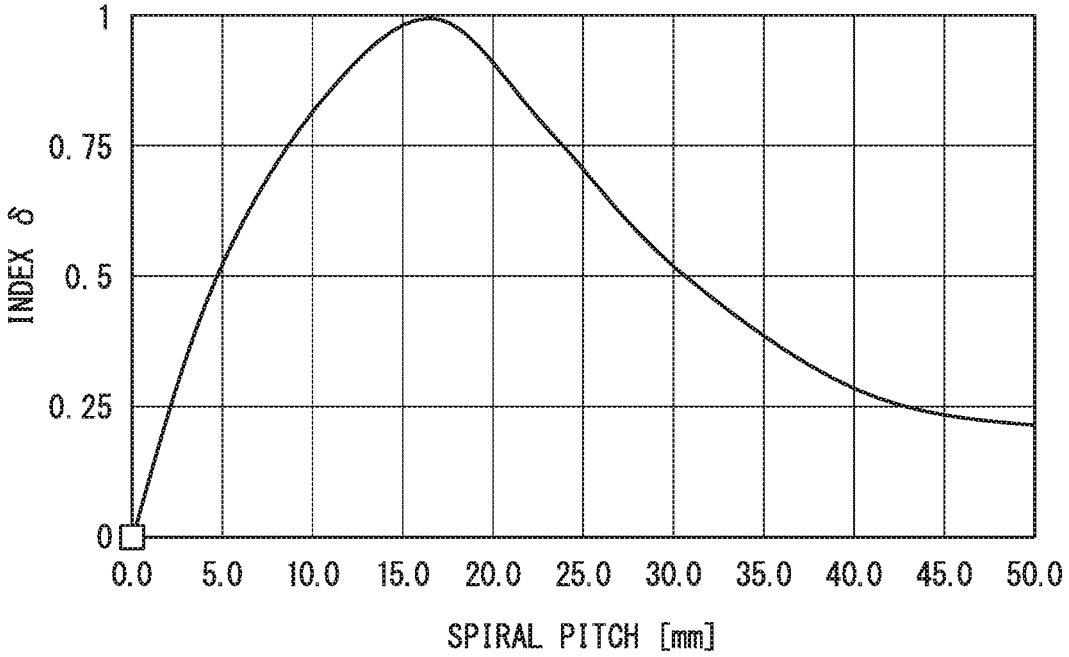
FIG. 25 is a graph having a horizontal axis for the pitch of the line-shaped projection and a vertical axis for the index σ.

In addition, FIG. 25 shows the evaluation result of the influence of the index δ on the spiral pitch. The pitch was varied while maintaining the number of spiral threads as three threads. The shape of the forming tool having the spiral pitch=0.0 coincides with the shape of a conical punch having no line-shaped projection. Therefore, $\delta=0.0$ is established. In the range in which the spiral pitch is small, since the line-shaped projection becomes dense and a valley having the sufficient index σn is not generated between the ridge and the ridge of the line-shaped projection, the circumstances is no longer suitable for successive forming. When the spiral pitch is increased, the ridges and the valleys are gradually generated in the distribution of the index σn. Therefore, δ increases gradually and comes close to 1.0. When the pitch increases, since the possibility of contact on the base surface increases, the suitability as successive forming is degraded.

From the above, in a case where the number of contact points is fixed and the spiral pitch is varied, when the spiral pitch is excessively small, partial contact cannot be realized in the vicinity of the line-shaped projection, working diverges from successive forming and comes close to hole widening performed with a conical punch. Therefore, successive forming is not appropriately executed. In the range in which the spiral pitch is significant, contact is likely to be caused in a location other than the line-shaped projection, and suitability as successive forming is degraded. That is, the spiral pitch of the contact part which can perform successive forming is limited to a certain range.

INDUSTRIAL APPLICABILITY

According to the present invention, it is possible to prevent occurrence of a stretch flange crack at the time of hole widening even in a high strength steel sheet having favorable elongation, and it is possible to improve shape accuracy of a stretched flange by suppressing spring-back.

BRIEF DESCRIPTION OF THE REFERENCE SYMBOLS

10, 10A TO 10L FORMING TOOL
11, 11' DIAMETER-INCREASING PORTION
12, 12*a* to 12*o* LINE-SHAPED PROJECTION
13, 13' BODY PORTION
14, 14' APEX PORTION
15 BOTTOM PORTION
16, 16' GRIPPING PORTION
110 STEEL SHEET
111 PILOT HOLE
S STEEL SHEET
S1 PILOT HOLE
100 FORMING TOOL
101 DIAMETER-INCREASING PORTION
110 STEEL SHEET
111 PILOT HOLE
112 HOLE
113 FLANGE
114 EDGE PORTION
115 STRETCH FLANGE CRACK

What is claimed is:

1. A hole widening and a stretched flange forming method comprising:

providing a forming tool which has a diameter-increasing portion increasing in diameter from a front end side toward a rear end side and a line-shaped projection formed to protrude outward from a surface of the diameter-increasing portion and having a spiral shape and continuously extending at least one round in a circumferential direction of the forming tool in a case of being seen from the front end side, and a workpiece in which a pilot hole is formed; and successively widening the pilot hole by pushing the forming tool into the pilot hole such that the line-shaped projection of the forming tool comes into point contact with a part of a circumferential edge portion of the pilot hole in the workpiece two times or more, and forming a stretched flange, wherein a number of a thread of the line-shaped projection is 2 to 7, and wherein a pitch of the line-shaped projection is 5.0 to 30.0 mm.

2. The hole widening and the stretched flange forming method according to claim 1, wherein when successively widening the pilot hole, the forming tool is pushed into the pilot hole while the forming tool rotates about a central axis thereof in a pushing direction.

3. The hole widening and the stretched flange forming method according to claim 1, wherein in a case of being seen in a cross section including a central axis of the diameter-increasing portion, two or more of the line-shaped projections are present on one circumferential surface of the diameter-increasing portion.

4. The hole widening and the stretched flange forming method according to claim 1, wherein a cross-sectional shape of the line-shaped projection has an arc shape at least a location which comes into contact with the circumferential edge portion of the pilot hole.

* * * * *